US011814876B2

(12) United States Patent
Huang

(10) Patent No.: US 11,814,876 B2
(45) Date of Patent: Nov. 14, 2023

(54) LOCK DEVICE WITH A CLUTCH

(71) Applicant: I-TEK METAL MFG. CO., LTD, Tainan (TW)

(72) Inventor: Tsung-Yu Huang, Tainan (TW)

(73) Assignee: I-TEK METAL MFG. CO., LTD, Tainan (TW)

( * ) Notice: Subject to any disclaimer, the term of this patent is extended or adjusted under 35 U.S.C. 154(b) by 142 days.

(21) Appl. No.: 17/683,501

(22) Filed: Mar. 1, 2022

(65) Prior Publication Data

US 2023/0265683 A1 Aug. 24, 2023

(30) Foreign Application Priority Data

Feb. 18, 2022 (TW) ..... 111106035

(51) Int. Cl.
*E05B 47/00* (2006.01)
*E05B 55/00* (2006.01)
*E05B 47/06* (2006.01)

(52) U.S. Cl.
CPC ..... *E05B 47/0012* (2013.01); *E05B 47/068* (2013.01); *E05B 55/005* (2013.01); *E05B 2047/0031* (2013.01)

(58) Field of Classification Search
CPC .. E05B 47/00; E05B 47/0012; E05B 47/0676; E05B 47/068; E05B 47/0684; E05B 55/00; E05B 55/005; E05B 2047/00; E05B 2047/013; E05B 2047/0026; E05B 2047/0027; E05B 2047/0028; E05B 2047/003; E05B 2047/0032; E05B 2047/0033; E05B 2047/0034; E05B 2047/0031
USPC ..... 70/134
See application file for complete search history.

(56) References Cited

U.S. PATENT DOCUMENTS 6,177,771 B1 1/2001 Kinzer et al.
6,622,535 B2 * 9/2003 Chiang ..... E05B 47/0692 70/277
6,634,140 B1 10/2003 Sellman
6,732,557 B1 * 5/2004 Zehrung ..... E05B 47/0607 70/462
6,786,006 B2 9/2004 Kowalczyk et al.
6,891,479 B1 * 5/2005 Eccleston ..... E05F 15/63 340/545.1
6,978,646 B2 * 12/2005 Raatikainen ..... E05B 47/0688 292/336.3
7,051,403 B2 5/2006 Homberg
(Continued)

*Primary Examiner* — Nathan Cumar

(57) ABSTRACT

A clutch includes an outer box and an intermediate member pivotably connected to the outer box. The intermediate member is coupled with an outer handle to pivot therewith. A torsion spring is disposed between the intermediate member and the outer box and biases the intermediate member to an initial position. A coupling member is pivotably mounted between the intermediate member and the outer box and is operatively connected to a first latch of a latch device of a lock device. When the coupling member and the intermediate member are jointly pivotable, pivotal movement of the outer handle causes the first latch to move from the latching position or the unlatching position. When the coupling member is not jointly pivotable with the intermediate member, pivotal movement of the outer handle is incapable of causing movement of the first latch. A lock device with the clutch is also disclosed.

19 Claims, 19 Drawing Sheets

(56) References Cited

U.S. PATENT DOCUMENTS 7,061,197 B1 6/2006 Mullet et al.
7,068,179 B2 6/2006 Snell et al.
7,143,547 B2 12/2006 Liles, Jr.
7,234,201 B2 6/2007 Brown et al.
7,282,883 B2 10/2007 Mullet et al.
7,296,380 B2 11/2007 Backman
7,316,096 B2 1/2008 Houser et al.
7,418,800 B1 9/2008 Sellman
7,484,333 B2 2/2009 Houser et al.
7,555,867 B2 7/2009 Liles, Jr.
7,717,155 B2 5/2010 Mullet
7,774,984 B2 8/2010 Hsu
7,966,771 B2 6/2011 Bienek
8,109,038 B2 2/2012 Houser et al.
8,169,169 B2 5/2012 Hass et al.
8,201,858 B1 * 6/2012 Moon ..... E05B 15/0013 292/33
8,248,005 B2 8/2012 Romer
8,390,219 B2 3/2013 Houser
8,393,054 B2 3/2013 Bienek
8,407,937 B2 4/2013 Houser
8,415,902 B2 4/2013 Burris et al.
8,434,268 B2 5/2013 Nixon
8,499,495 B2 8/2013 Houser et al.
8,540,290 B2 * 9/2013 Chen ..... E05B 63/16 292/144
8,547,046 B2 10/2013 Burris et al.
8,601,744 B2 12/2013 Wildforster et al.
8,695,277 B2 4/2014 Romer et al.
8,826,598 B2 9/2014 Ranaudo et al.
8,875,344 B2 11/2014 Salutzki et al.
8,904,710 B2 12/2014 Romer et al.
8,963,683 B2 2/2015 Romer
9,003,630 B2 4/2015 Hufen
9,045,927 B1 6/2015 Hoffberg
9,097,051 B2 8/2015 Hellwig
9,115,526 B2 8/2015 Houser et al.
9,121,217 B1 9/2015 Hoffberg
9,163,446 B2 10/2015 Houser et al.
9,181,744 B2 11/2015 Salutzki et al.
9,187,942 B2 11/2015 Wildforster
9,297,194 B2 3/2016 Bienek et al.
9,506,284 B2 11/2016 Braverman et al.
9,514,583 B2 12/2016 Zasowski et al.
9,631,412 B2 4/2017 Hellwig et al.
9,683,378 B2 6/2017 Houser et al.
9,695,620 B2 7/2017 Zasowski et al.
9,869,117 B2 1/2018 Houser et al.
9,995,076 B1 6/2018 Hoffberg
10,006,236 B2 6/2018 Hellwig et al.
10,024,094 B2 7/2018 Bell et al.
10,030,425 B2 7/2018 Zasowski et al.
10,030,426 B2 7/2018 Langenberg
10,077,591 B2 9/2018 Hass
10,180,023 B2 1/2019 Zasowski et al.
10,208,520 B2 2/2019 Long et al.
10,236,801 B2 3/2019 Dye et al.
10,253,540 B2 4/2019 Bell et al.
10,280,670 B2 5/2019 Roberts
10,280,678 B1 5/2019 Rendon, Jr. et al.
10,304,272 B2 5/2019 Kvinge et al.
10,344,502 B2 7/2019 McKibben et al.
10,415,301 B2 9/2019 Kuan
10,472,873 B2 11/2019 Ladha et al.
10,559,151 B2 2/2020 Kvinge et al.
10,704,310 B1 7/2020 Barbon et al.
10,704,313 B2 7/2020 Houser et al.
10,724,288 B2 7/2020 Baumgarte
2005/0154612 A1 7/2005 Smith et al.
2007/0114800 A1 * 5/2007 Kuo ..... E05B 63/044 292/244
2007/0256362 A1 11/2007 Hansen
2008/0011030 A1 * 1/2008 Ferreira Sanchez ..... E05B 47/0692 70/223
2013/0009785 A1 1/2013 Finn et al.
2014/0026627 A1 * 1/2014 Rai ..... E05C 1/10 70/344
2014/0255252 A1 9/2014 Stratman et al.
2016/0258189 A1 * 9/2016 Frolov ..... E05B 63/08
2016/0348415 A1 * 12/2016 Baumgarte ..... E05F 15/40
2018/0334841 A1 11/2018 Langenberg et al.
2019/0043296 A1 * 2/2019 Baumgarte ..... G07C 9/00571
2019/0145138 A1 5/2019 Eickhoff
2019/0153764 A1 5/2019 Baumgarte
2019/0264486 A1 8/2019 Toloday et al.
2019/0319557 A1 10/2019 Dye et al.
2019/0338576 A1 11/2019 Wang
2019/0345738 A1 11/2019 McKibben et al.
2019/0383080 A1 12/2019 Barbon et al.
2020/0190885 A1 6/2020 Coleman
2020/0256108 A1 8/2020 Shetty et al.
2021/0023248 A1 1/2021 Townsend et al.
2021/0056791 A1 2/2021 Shen

* cited by examiner

LOCK DEVICE WITH A CLUTCH

BACKGROUND OF THE INVENTION

The present invention relates to a lock device and, more particularly, to a lock device including an outer operating device having an outer handle that cannot be operated to move a latch from an extended, latching position to a retracted, unlatching position when the lock device is in a locked state.

Door locks are generally installed on doors to control opening/closing. When a door is closed and a door lock mounted on the door is locked state, a latch of the door lock is coupled with a groove in a door frame, avoiding opening of the door. When the door lock is unlocked, a handle (an outer handle on an outer side or an inner handle on an inner side) can be operated to retract the latch, permitting opening of the door. Thus, the door lock cooperates with the door to provide door access control.

Many known door locks are mechanical designs, and most mechanical structures of the door locks would have to he redesigned when the manufacturers wish to upgrade the mechanical door locks into door locks for electronical control, leading to a significant increase in the costs. It is beneficial in research and development as well as cost reduction if more components of currently available mechanical door locks can be used in electronically controlled door locks.

BRIEF SUMMARY OF THE INVENTION

In a first aspect, the present invention provides a door lock including:

- a latch device including a first latch movable between a latching position and an unlatching position;
- an outer escutcheon to an outer side of the latch device;
- an outer handle pivotably mounted to an outer side of the outer escutcheon; and
- a clutch disposed on the outer side of the latch device and located on an inner side of the outer escutcheon, wherein the clutch includes a pivotable intermediate member coupled to the outer handle to pivot therewith, wherein the clutch further includes a coupling member operatively coupled to the first latch, wherein the coupling member is configured to or not to jointly pivot with the intermediate member, wherein when the coupling member and the intermediate member are jointly pivotable, pivotal movement of the outer handle causes the first latch to move from the latching position or the unlatching position, and wherein when the coupling member is not jointly pivotable with the intermediate member, pivotal movement of the outer handle is incapable of causing movement of the first latch.

In the example embodiments, the clutch and the inner and outer operating devices may be varied without altering the latch device, providing electronic control of the mechanical type latch device to achieve the locking function (such that the first latch cannot move to the unlatching position by operating the outer handle) or the unlocking function (such that the first latch can move to the unlatching position by operating the outer handle). Thus, redesigning and corresponding manufacturing of the latch device for electronic control are not required. Namely, currently available mechanical type latch device can be used, reducing the costs of manufacturing and design. For general consumers, the mechanical type latch device can still be used to achieve electronic control by replacing the inner and outer operating devices.

In an example, the clutch further includes a clutch member movably coupled to the intermediate member and jointly pivotable with the intermediate member. The clutch member includes an engaging arm. The clutch member is movable along a pivotal axis of the intermediate member between an engagement position and a disengagement position. When the clutch member is in the engagement position, the coupling member and the intermediate member are jointly pivotable. When the clutch member is in the disengagement position, the coupling member is incapable of pivoting jointly with the intermediate member.

In an example, the intermediate member further includes a mounting hole extending along the pivotal axis of the intermediate member and a through-hole extending in a radial direction perpendicular to the pivotal axis of the intermediate member and extending from an outer side of the intermediate member to the mounting hole. The clutch member is movably received in the through-hole. The coupling member includes a pivotal portion having an outer periphery and an engaging groove extending from the outer periphery. The pivotal portion is pivotably received in the mounting hole. When the clutch member is aligned with the engaging groove, the clutch member is movable from the disengagement position to the engagement position. When the clutch member is not aligned with the engaging groove, the clutch member is not movable from the disengagement position to the engagement position. When the clutch member is in the disengagement position, the engaging arm is located on an outer side of the engaging groove. When the clutch member is in the engagement position, the engaging arm engages with the engaging groove.

In an example, the clutch further includes a driving device including:

- a motor;
- a shaft configured to be driven by the motor to rotate, wherein the shaft includes an outer periphery having a threaded section;
- a helical elastic element in threading connection with the threaded section of the shaft, wherein the helical elastic element is compressible and includes a first tang and a second tang, wherein the helical elastic element moves along a longitudinal axis of the shaft when the shaft rotates; and a sliding block including a compartment having first and second walls opposite to each other, wherein the sliding block further includes an activation end located outside of the compartment, wherein the second wall is located between the first wall and the activation end along the longitudinal axis of the shaft, wherein the sliding block further includes an extension arm extending from the activation arm, wherein the shaft is received in the compartment, Wherein the first tang of the helical elastic element is adjacent to the first wall, wherein the second tang of the helical elastic element is adjacent to the second wall, wherein the first tang and the second tang are configured to be restricted and retained in place by the first and second walls when the shaft rotates, wherein when the helical elastic element moves and the first tang abuts against the first wall, the sliding block moves away from the intermediate member along the longitudinal axis of the shaft, and the clutch member moves to the disengagement position, wherein when the helical elastic element moves and the second tang abuts against the second wall, the sliding block moves towards the intermediate member along the longitudinal axis of the shaft, and the clutch member moves to the engagement position, wherein when the clutch member is not aligned with the engaging groove and the helical elastic element moves towards the intermediate member, a section of the helical elastic element between the threaded section and the second tang is compressed by the threaded section and the second wall.

In an example, the threaded section of the shaft has one turn. The helical elastic element is a compression spring. Each of the first and second tangs is rectilinear and extends in a tangential direction of an associated one of two ends of the compression spring.

The threaded section of the shaft include only one turn, which causes less restriction to the helical elastic element. Thus, the compression extent of the helical elastic element along the longitudinal axis of the shaft may be maximized. The motor can still rotate in the first direction when the clutch member cannot move, reducing damage to the motor resulting from erroneous operation.

In an example, the lock device further includes:

an actuating member, wherein the intermediate member further includes a first end face and a second end face spaced from the first end face along the pivotal axis of the intermediate member, wherein the mounting hole extends from the first end face along the pivotal axis of the intermediate member but spaced from the second end face, wherein the actuating member is mounted on the second end face 80 of the intermediate member, and wherein the actuating member includes a push block protruding towards the second end face;

an outer box mounted to the outer escutcheon and including a stop member, wherein the intermediate member, the coupling member, and the driving device are received in the outer box: and a torsion spring having two ends, wherein the stop member and the push block are located between the two ends of the torsion spring, wherein the two ends of the torsion spring biases the push block to retain the intermediate member in an initial position in which the clutch member is aligned with the engaging groove.

In an example, the clutch further includes a driving device including:

an inner box;

a motor including a driving toothed portion, wherein the motor is received in an inner box;

a sliding block including:

a first block received in the inner box and movable along a rotational axis of the driving toothed portion, wherein the first block includes an inner end and an activation end, wherein the first block further includes a compartment formed between the inner end and the activation end, wherein the first block further includes an opening extending from an outer surface thereof to the compartment, and wherein the clutch member abuts against the activation end;

a second block received in the compartment and movable relative to the first block along the rotational axis of the driving toothed portion, wherein the second block further includes a follower toothed portion extending out of the first block via, the opening and meshed with the driving toothed portion;

a push spring disposed between the second block and a sidewall of the compartment, wherein the push spring biases the second block against another sidewall of the compartment, wherein when the driving toothed portion rotates while the clutch member is aligned with the engaging groove and, the first and second blocks together move along the rotational axis of the driving toothed portion, wherein when the driving toothed portion rotates while the clutch member is not aligned with the engaging groove, the first block is not moved, and the second block moves along the rotational axis of the driving toothed portion towards the intermediate member and compresses the push spring.

In an example, the lock device further comprises a supporting spring. The clutch member further includes an abutting portion which is larger than the engaging arm and made of plastic material. The engaging arm is made of metal material. The abutting portion is located on an outer side of the intermediate member and abuts against one of the activation end and the extension arm of the sliding block. The supporting spring is disposed between the abutting portion and the intermediate member and biases the clutch member to the disengagement position.

The abutting portion of the clutch member may be made of plastic material, such that the friction between the abutting portion and the sliding block can be reduced during rotation of the intermediate member, permitting smoother operation of the outer handle.

In an example, the lock device further comprises:

an outer box mounted on the outer escutcheon and including a stop member, wherein the intermediate member, the coupling member, and the driving device are received in the outer box, wherein the intermediate member further includes a first end face and a second end face spaced from the first end face along the pivotal axis of the intermediate member, wherein the mounting hole extends from the first end face along the pivotal axis of the intermediate member but spaced from the second end face, and wherein the intermediate member further includes a push block protruding towards the second end face; and a torsion spring having two ends, wherein the stop member and the push block are located between the two ends of the torsion spring, wherein the two ends of the torsion spring biases the push block to retain the intermediate member in an initial position in which the clutch member is aligned with the engaging groove.

In an example, the lock device further comprises an inner operating device mounted to another side of the latch device. The latch device further includes a second latch. The inner operating device includes a main board and a sensor electrically connected to the main board. The inner operating device further includes an inner operating knob operatively connected to the second latch. The inner operating knob is configured to activate the sensor. Rotation of the inner operating knob causes movement of the second latch between an extended position and a retracted position. When the second latch is in the extended position, the sensor is in one of an activated state and a non-activated state, and the driving device is not operable, such that the clutch member is incapable of moving from the disengagement position to the engagement position. When the second latch is in the retraced position, the sensor is in another of the activated state and the non-activated state, and the driving device is operable, such that the clutch member is movable from the disengagement position to the engagement position.

In an example, the lock device further comprises a lock core mounted to the outer escutcheon. A portion of the lock core is located in the latch device. The lock core is operatively connected to the second latch. The inner operating knob is operatively connected to the lock core. The inner operating device further includes an assembling member. The main board and the sensor are mounted to the assembling member. The inner operating device further includes a follower wheel pivotably mounted to the assembling member and a driving wheel meshed with the follower wheel. The follower wheel is operatively coupled between the inner operating knob and the lock core. The follower wheel includes an activating portion. When the second latch is in the retracted position, the sensor is not activated by the activating portion. When the second latch is in the extended position, the sensor is activated by the activating portion.

In another aspect, the present invention provides a clutch adapted to be mounted to an outer side of a latch device of a lock device and configured to be operatively connected to an outer operating device of the lock device. The clutch comprises:

an outer box;

an intermediate member pivotably connected to the outer box, wherein the intermediate member is configured to couple with an outer handle of the outer operating device to pivot therewith;

a torsion spring disposed between the intermediate member and the outer box, wherein the torsion spring biases the intermediate member to an initial position; and a coupling member pivotably mounted between the intermediate member and the outer box, wherein the coupling member is configured to be operatively connected to a first latch of the latch device, wherein the coupling member is configured to control the intermediate member to or not to pivot jointly with the intermediate member, wherein when the coupling member and the intermediate member are jointly pivotable, pivotal movement of the outer handle causes the first latch to move from the latching position or the unlatching position, and wherein when the coupling member is not jointly pivotable with the intermediate member, pivotal movement of the outer handle is incapable of causing movement of the first latch.

The present invention will become clearer in light of the following detailed description of illustrative embodiments of this invention described in connection with the drawings.

Figure 1:
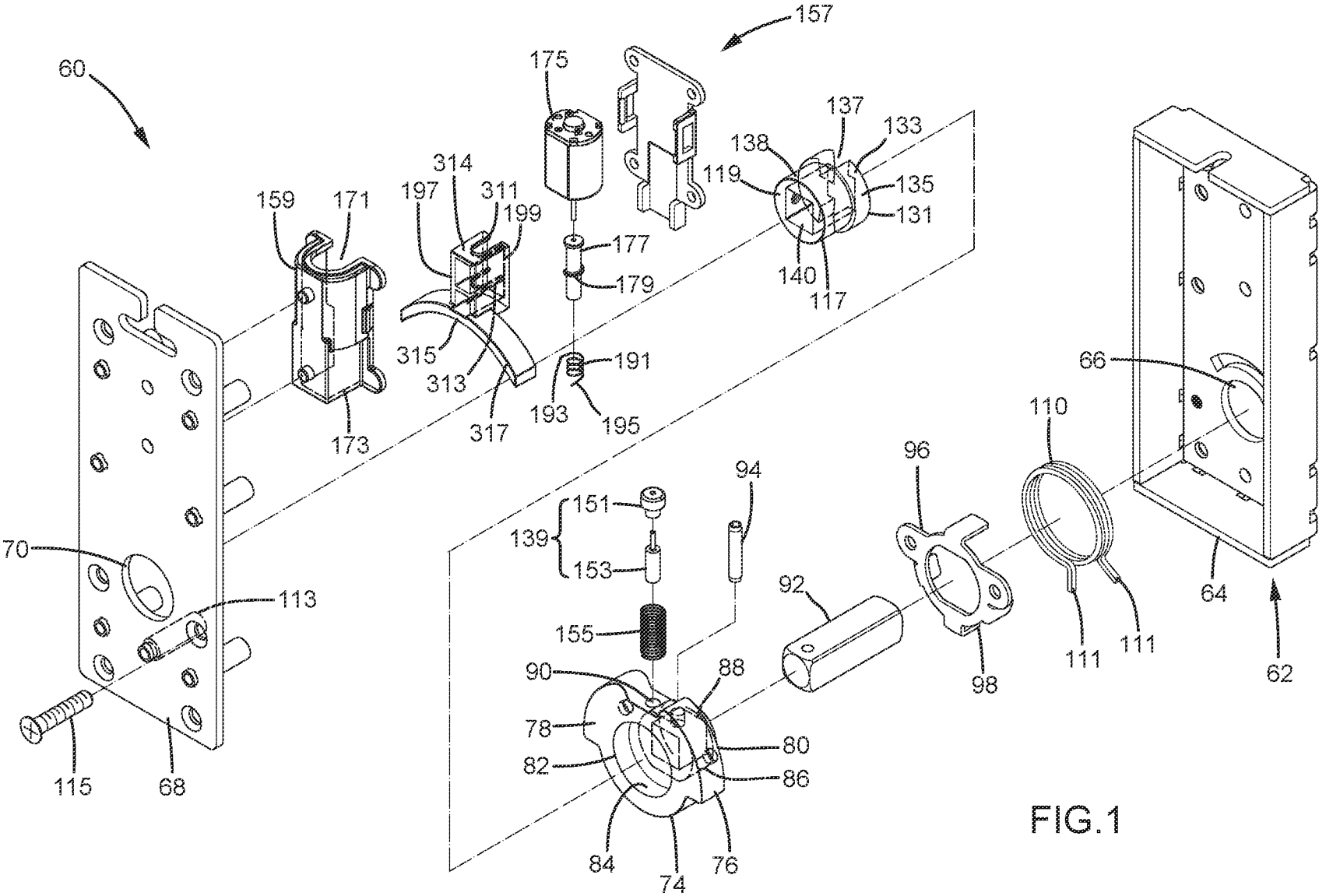
FIG. 1 is an exploded, perspective view of a clutch of a first embodiment according to the present invention.
Figure 2:
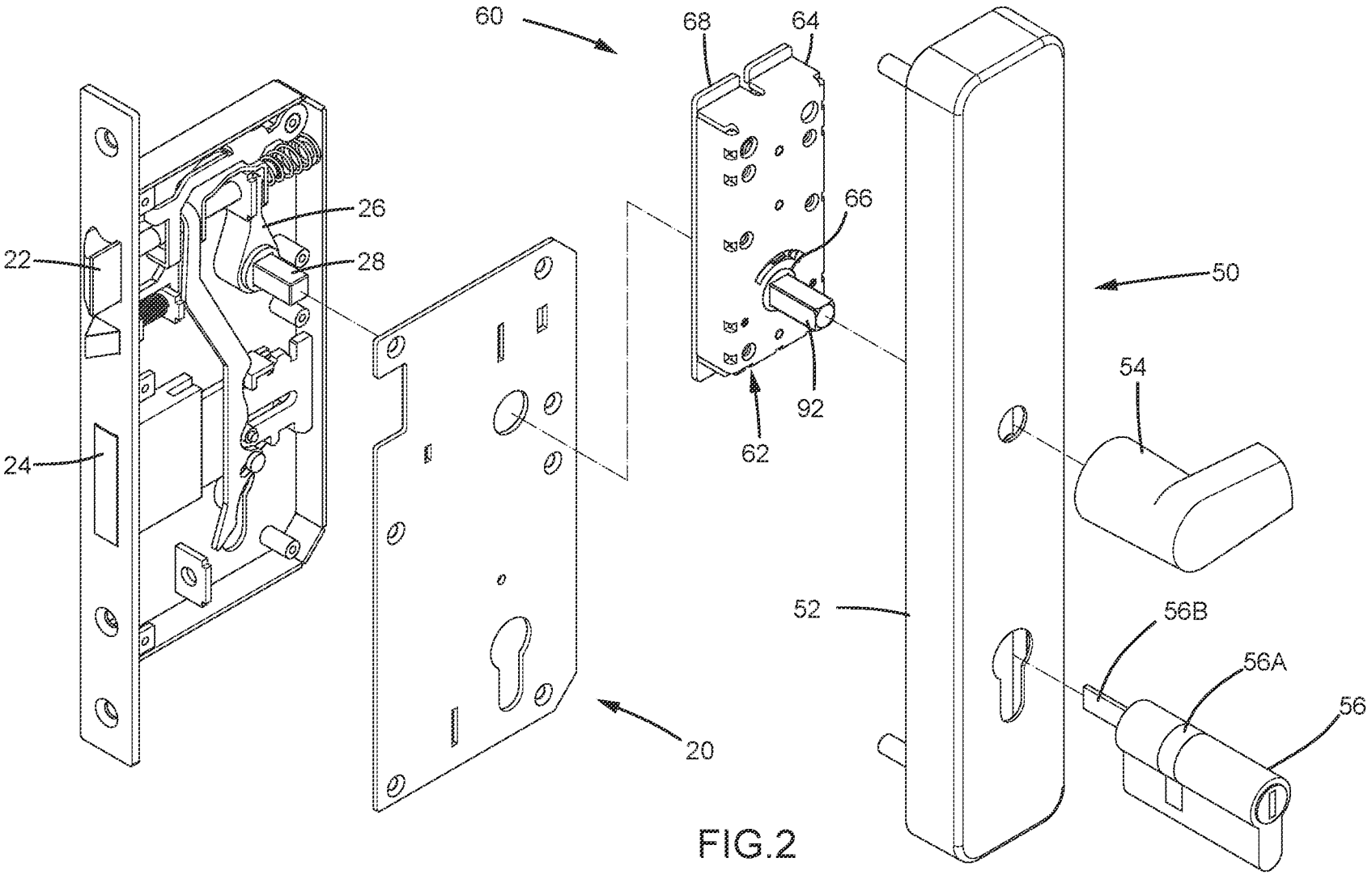
FIG. 2 is an exploded, perspective view of a door lock.
Figure 3:
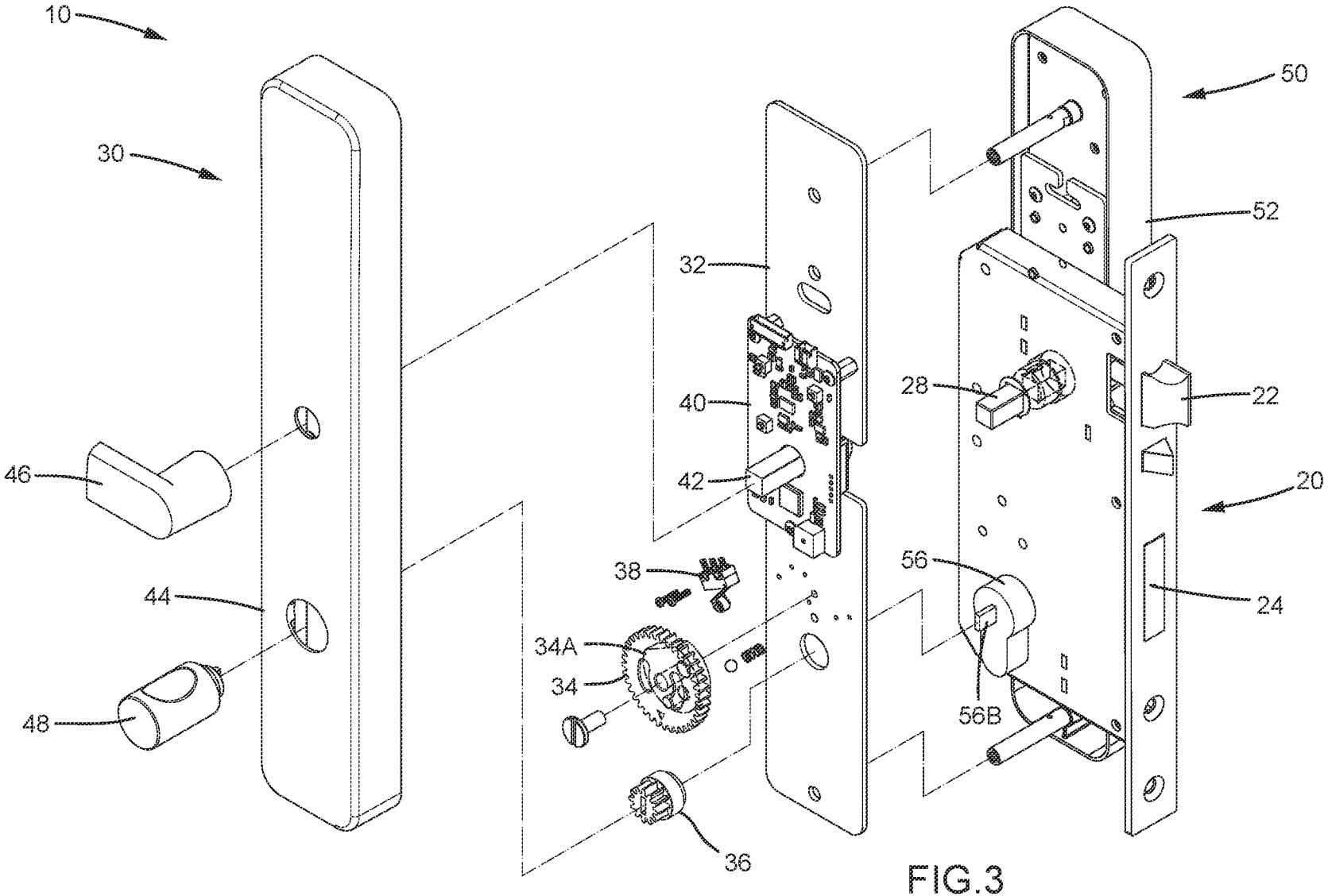
FIG. 3 is another exploded, perspective view of the door lock.
Figure 4:
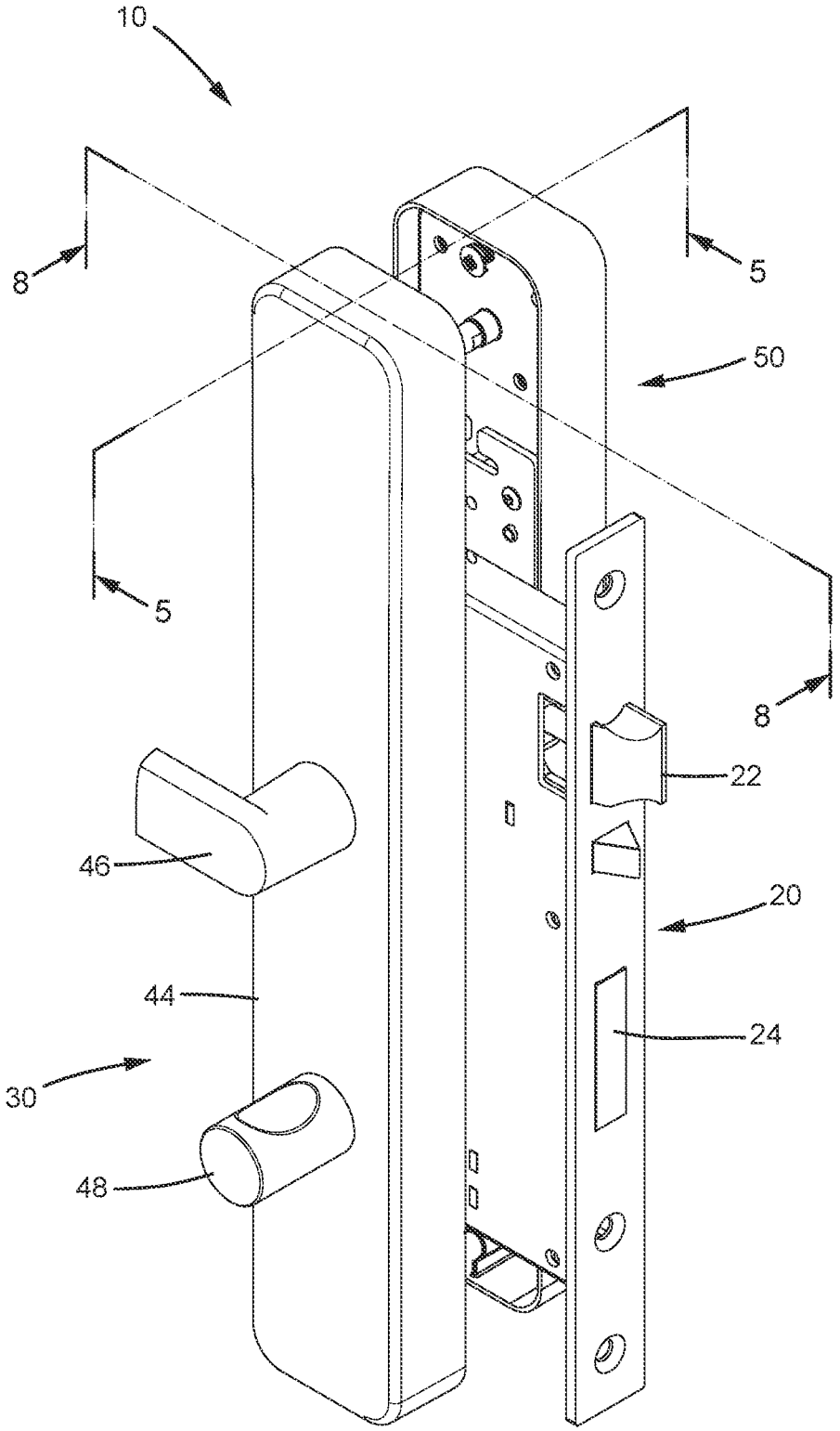
FIG. 4 is a perspective view of the door lock.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second". "lower", "inner", "outer", "side", "end", "portion", "section", "longitudinal", "axial", "radial", "circumferential". "horizontal", "outward", "inward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 10:
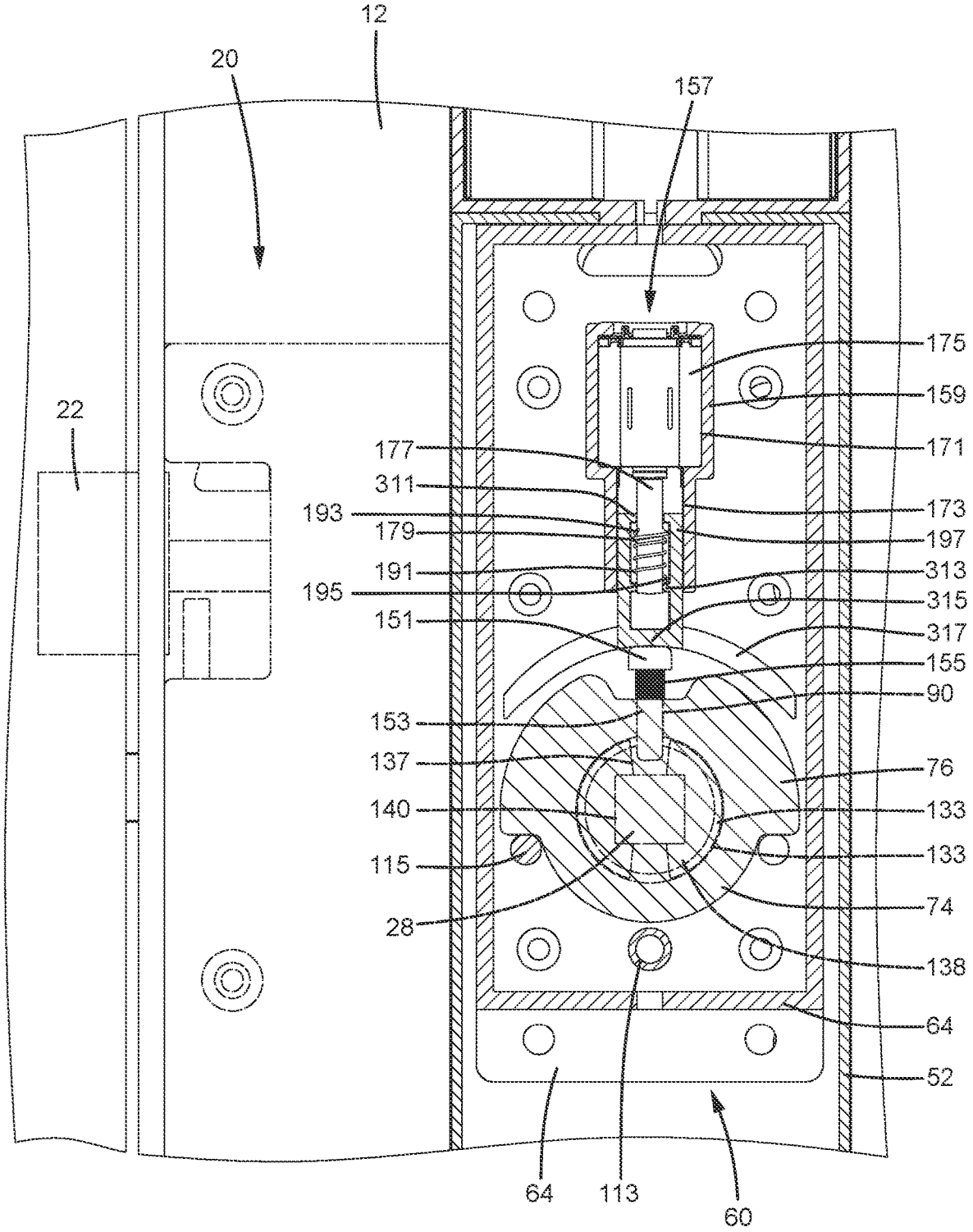
FIG. 10 is a cross sectional view taken along section line 10-10 of FIG. 9.
Figure 11:
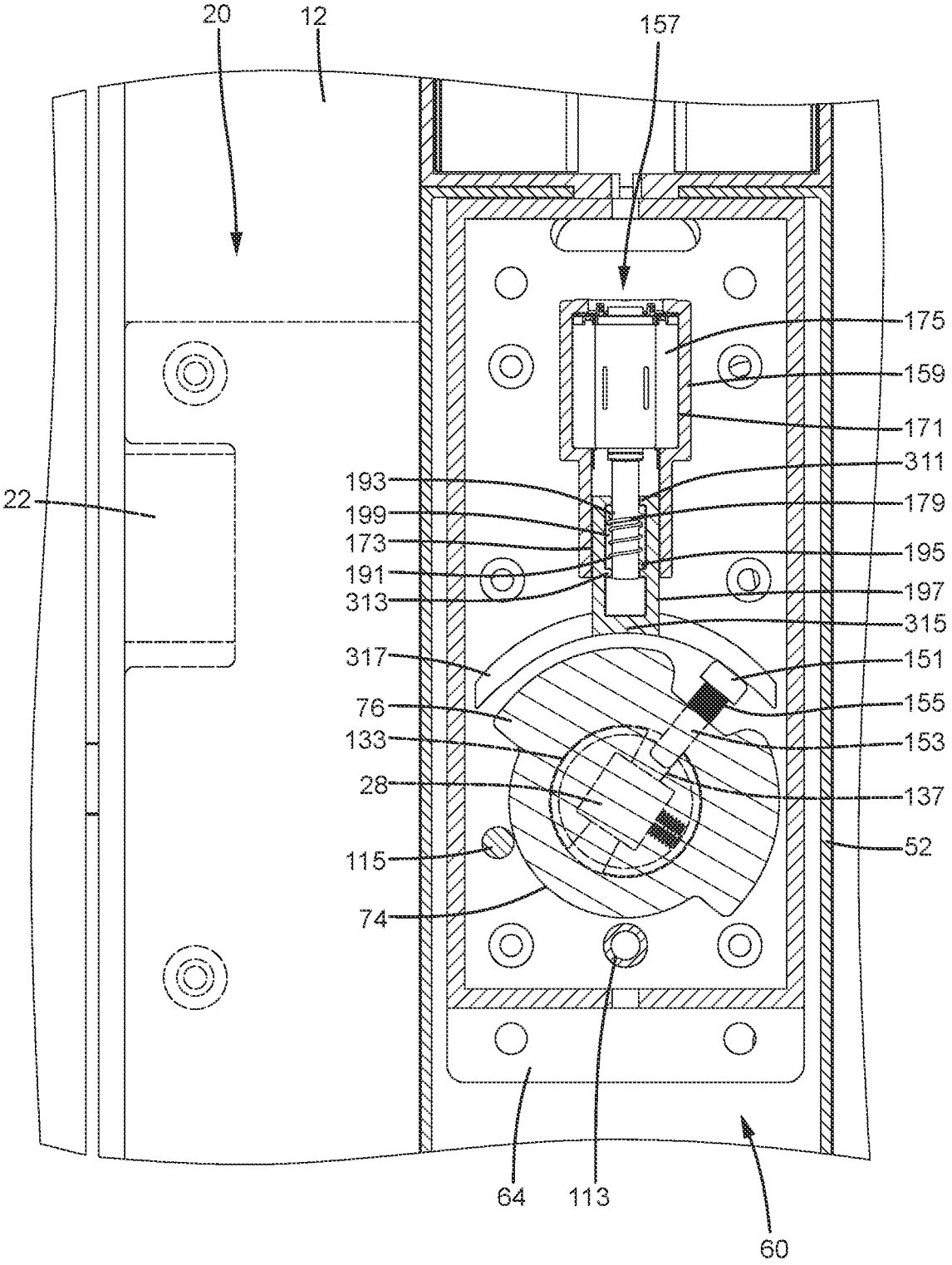
FIG. 11 is a view similar to FIG. 10 with the clutch member in the engagement position and with the outer handle pivoted.

The present invention relates to a lock device with a clutch and, more particularly, to a mechanical type lock device incorporating an electronically controlled clutch, such that the lock device can be provided with an electronic unlocking function while using at least a portion of components of the lock device. FIGS. 1-6 show a lock device 10 of a first embodiment according to the present invention. The lock device 10 includes a latch device 20 mounted in a door 12 and outer and inner operating devices 50 and 30 disposed on two sides of the door 12. The latch device 20 includes a first latch 22 movable between a latching position (FIGS. 6, 6A, 7, 8, and 10) and an unlatching position (FIG. 11). The first latch 22 is operatively connected to an actuating member 26 that is pivotable. A driving rod 28 is connected to the actuating member 26 to pivot jointly. The latch device 20 further includes a second latch 24 movable between an extended position (FIG. 12) and a retracted position (FIGS. 6, 6A, 7, 8, and 10).

The outer operating device 50 includes an outer escutcheon 52 mounted to an outer side of the door 12 and an outer handle 54. In this embodiment, the outer handle 54 is pivotable and substantially L-shaped. The outer operating device 50 further includes a lock core 56 mounted to the outer escutcheon 52. The lock core 56 includes a push member 56A which is rotatable and a connecting member 56B extending from a tail end thereof The push member 56A is located between the connecting member 56B and a keyway of the lock core 56 in an axial direction of the lock core 56. The keyway is exposed on the outer escutcheon 52, and a key can be inserted into the keyway to operate the lock core 56. The push member 56A of the lock core 56 is located in the latch device 20 and is operatively connected to the second latch 24. The connecting member 56B is located outside of the latch device 20. When the key is used to operate the lock core 56, the push member 56A can be rotated to move the second latch 24 to the extended position or the retracted position.

The inner operating device 30 includes an inner escutcheon 44 mounted to the inner side of the door 12 and an assembling member 32 mounted to an inner side of the inner escutcheon 44. The inner operating device 30 further includes a main board 40 mounted to the assembling member 32 and an inner connecting member 42. The inner connecting member 42 is connected to the driving rod 28 to pivot jointly. An inner handle 46 is disposed to an outer side of the inner escutcheon 44 and is connected to the inner connecting member 42 to pivot jointly. The inner operating device 30 further includes a sensor 38 mounted to the assembling member 32, a follower wheel 34 pivotal mounted to the assembling member 32, and a driving wheel 36 rotatably mounted to the assembling member 32. The follower wheel 34 and the driving wheel 36 are gears in this embodiment and mesh with each other. The driving wheel 36 is connected to the connecting member 56B of the lock core 56 to rotate jointly. The follower wheel 34 includes an activating portion 34A for activating the sensor 38.

The inner operating device 30 further includes an inner operating knob 48 rotatably mounted to the inner escutcheon 44. The inner operating knob 48 is connected to the driving wheel 36 to rotate jointly. Thus, when the inner operating knob 48 is rotated, the follower wheel 34 and the push member 56A of the lock core 56 rotate jointly, such that the activating portion 34A of the follower wheel 34 rotates from a position not activating the sensor 38 to another position activating the sensor 38 or vice versa.

The lock device 10 further comprises a clutch 60 disposed between the outer operating device 50 and the latch device 20. The clutch 60 includes an outer box 62 mounted to an inner side of the outer escutcheon 52. The outer box 62 includes a first portion 64 and a second portion 68 coupled with the first portion 64. The first portion 64 includes an axial hole 66. The second portion 68 includes a coupling hole 70 and a stop member 113 extending towards the first portion 64. A longitudinal axis of the coupling hole 70 is coincident with a longitudinal axis of the axial hole 66. Furthermore, the second portion 68 includes a limiting member 115 extending towards the first portion 64.

The clutch 60 further includes an intermediate member 74 pivotably mounted to the outer box 62 and a coupling member 117 pivotably mounted to the intermediate member 74. The intermediate member 74 includes an enlarged portion 76 having a first end face 78 and a second end face 80 spaced from the first end face 78 along the longitudinal axis of the axial hole 66. The intermediate member 74 further includes a spindle coupling portion 86 extending from the second end face 80. The enlarged portion 76 includes a mounting hole 82 extending from the first end face 78 along the axial hole 66 but spaced from the second end face 80. The mounting hole 82 includes an inner periphery 84. The enlarged portion 76 further includes a through-hole 90 extending radially from an outer periphery through the inner periphery 84 of the mounting hole 82. The spindle coupling portion 86 includes a connecting hole 88 extending along the longitudinal axis of the axial hole 66 and spaced from the mounting hole 82. The spindle coupling portion 86 of the intermediate member 74 is rotatably coupled with the axial hole 66 of the first portion 64. Thus, the pivotal axis of the intermediate member 74 is coincident with the longitudinal axis of the axial hole 66.

The coupling member 117 includes a first side 119 and a second side 131. The coupling member 117 further includes a coupling portion 138 extending along the pivotal axis of the intermediate member 74 from the first side 119 towards but spaced from the second side 131. The coupling member 117 further includes a pivotal portion 133 extending along the pivotal axis of the intermediate member 74 from the second side 131 to the coupling portion 138. The pivotal portion 133 includes an outer periphery 136 and an engaging groove 137 extending from the outer periphery 135 in a radial direction of the coupling member 117. The coupling member 117 further includes an engaging hole 140 extending along the pivotal axis of the intermediate member 74 from the first side 119 to the second side 131. The engaging hole 140 intercommunicates with the engaging groove 137.

The coupling portion 138 of the coupling member 117 is pivotably coupled with the coupling hole 70 of the second portion 68. Furthermore, the pivotal portion 133 is pivotably coupled with the mounting hole 82 of the intermediate member 74. Thus, the coupling member 117 can pivot independently relative to the intermediate member 74.

The clutch 60 further includes a spindle 92, an actuating member 96, and a torsion spring 110. An end of the spindle 92 is coupled with the mounting hole 88 of the spindle coupling portion 86, and a pin 94 extends through the spindle 92 and the spindle coupling portion 86 for securing purposes. Thus, the spindle 92 and the intermediate member 74 can pivot jointly, and the end of the spindle 92 is located outside of the first portion 64.

The actuating member 96 is mounted to the second end face 80 of the intermediate member 74 to pivot therewith. The actuating member 96 includes a push block 98 extending towards the first portion 64. The torsion spring 110 is mounted around the spindle coupling portion 86 of the intermediate member 74. Two ends 111 of the torsion spring 110 abut against two sides of the stop member 113, and the push block 98 is located between the two ends 111. Thus, the push block 98 is pressed by the two ends 111 of the torsion spring 110 to bias the intermediate member 74 to an initial position (see FIG. 7). When the intermediate member 74 is in the initial position, a lever of the outer handle 54 is in a horizontal state, and a side of the enlarged portion 76 of the intermediate member 74 abuts the limiting member 115, pivotal movement in a single direction is permitted when the intermediate member 74 is in the initial position.

Figure 9:
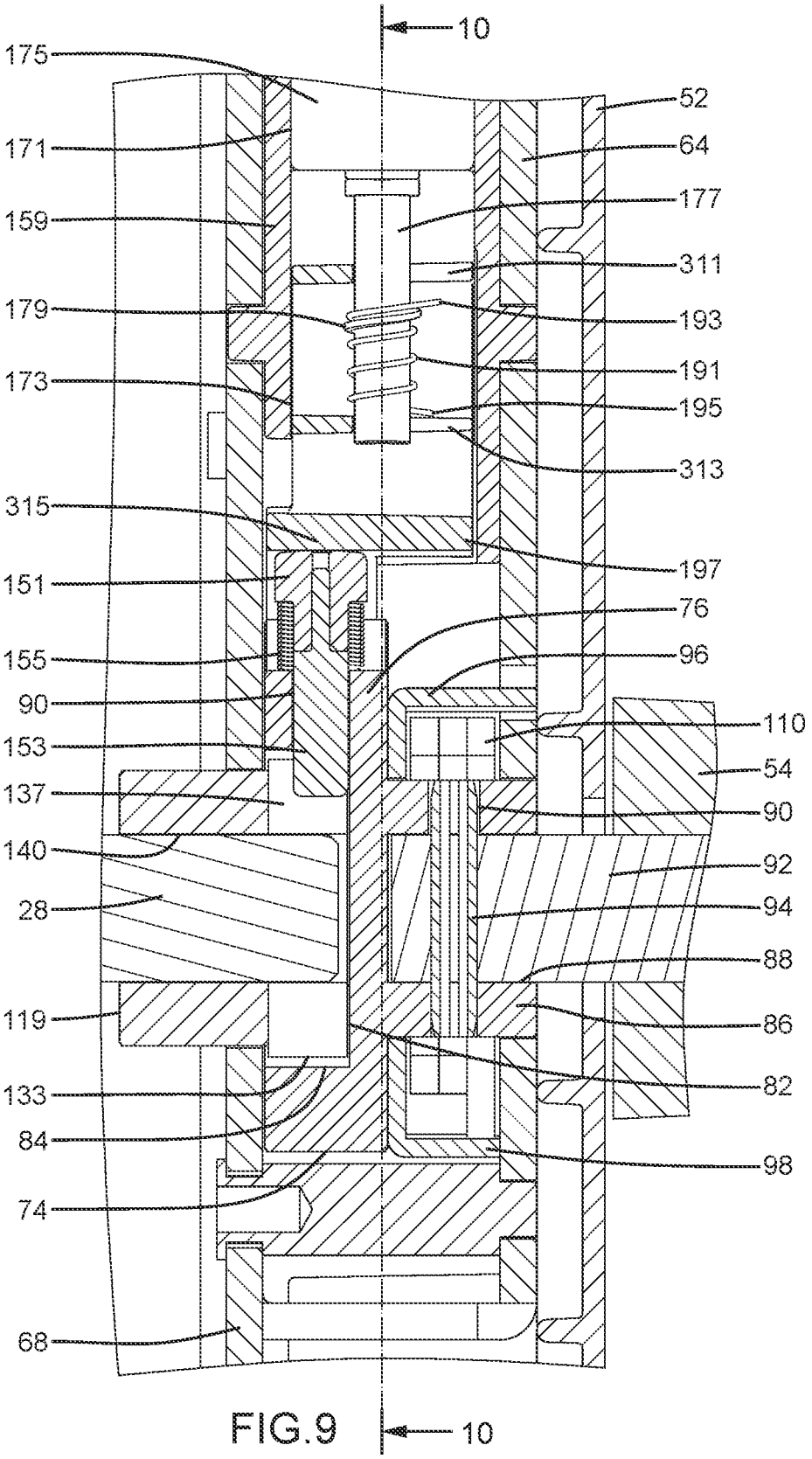
FIG. 9 is a cross sectional view illustrating the clutch member moved to an engagement position.

The clutch 60 further includes a clutch member 139 movably coupled with the intermediate member 74 and jointly pivotable with the intermediate member 74. The clutch member 139 includes an abutting portion 151 made of plastic material and an engaging arm 153 made of metal material. The abutting portion 151 may be slightly, larger than the engaging arm 153. The abutting portion 151 is located on an outer side of the intermediate member 74. The engaging arm 153 is movably received in the through-hole 90 of the intermediate member 74. Thus, the clutch member 139 can move along a longitudinal axis of the through-hole 90 between a disengagement position (FIGS. 5, 6, 6A, and 12) and an engagement position (FIGS. 9-11). Furthermore, a supporting spring 155 is disposed around the engaging arm 153 and between the abutting portion 151 and the intermediate member 74. The supporting spring 155 biases the clutch member 139 to the disengagement position.

The clutch 60 further includes a driving device 157 for driving the clutch member 139. The driving device 157 includes an inner box 159 mounted between the first and second portions 64 and 68 of the outer box 62. The inner box 159 includes a receiving groove 171 and a sliding groove 173 extending from an end of the receiving groove 171 to an outer surface of the inner box 159. A motor 175 is received in the receiving groove 171 and can be supplied with electricity for operation. The motor 175 includes a rotor coupled to a shaft 177 to rotate jointly. The shaft 177 includes a threaded section 179 at an outer periphery thereof The threaded section 179 has one turn. A helical elastic element 191 is mounted around the shaft 177. The helical elastic element 191 includes a first tang 193 extending along a tangential direction of an end of the helical elastic element 191 and a second tang 195 along a tangential direction of another end of the helical elastic element 191. The helical elastic element 191 is in threading connection with the threaded section 179 of the shaft 177. In an embodiment, the helical elastic element 191 is a compression spring, and the first and second tangs 193 and 195 are rectilinear sections extending from two ends of the compression spring.

The driving device 157 further includes a sliding block 197 movably coupled with the inner box 159. The sliding block 197 includes an inner end 314 and an activation end 315. The sliding block 197 further includes a compartment 199 between the inner end 314 and the activation end 315. The compartment 199 includes first and second walls 311 and wall 313 in the inner end 314. The second wall 313 is located between the first wall 311 and the activation end 315 along the longitudinal axis of the shaft 177. The activation end 315 includes an extension arm 317 extending in a circumferential direction about a pivotal axis of the intermediate member 74 towards two sides of the sliding block 197.

The sliding block 197 is slidably received in the sliding groove 173. The extension arm 317 is located outside of the inner box 159. The abutting portion 151 of the clutch member 139 abuts against the activation end 315 of the sliding block 197. The shaft 177 and the helical elastic element 191 are located in the compartment 199, The first tang 193 of the helical elastic element 191 is adjacent to the first wall 311. The second tang 195 of the helical elastic element 191 is adjacent to the second wall 313. Thus, when the shaft 177 rotates, the first and second tangs 193 and 195 of the helical elastic element 191 are restrained by the compartment 199 and, thus, cannot rotate jointly with the shaft 177. As a result, when the shaft 177 rotates, the threaded section 199 pushes the helical elastic element 191 in an uncompressed state to move along the shaft 177.

Figure 5:
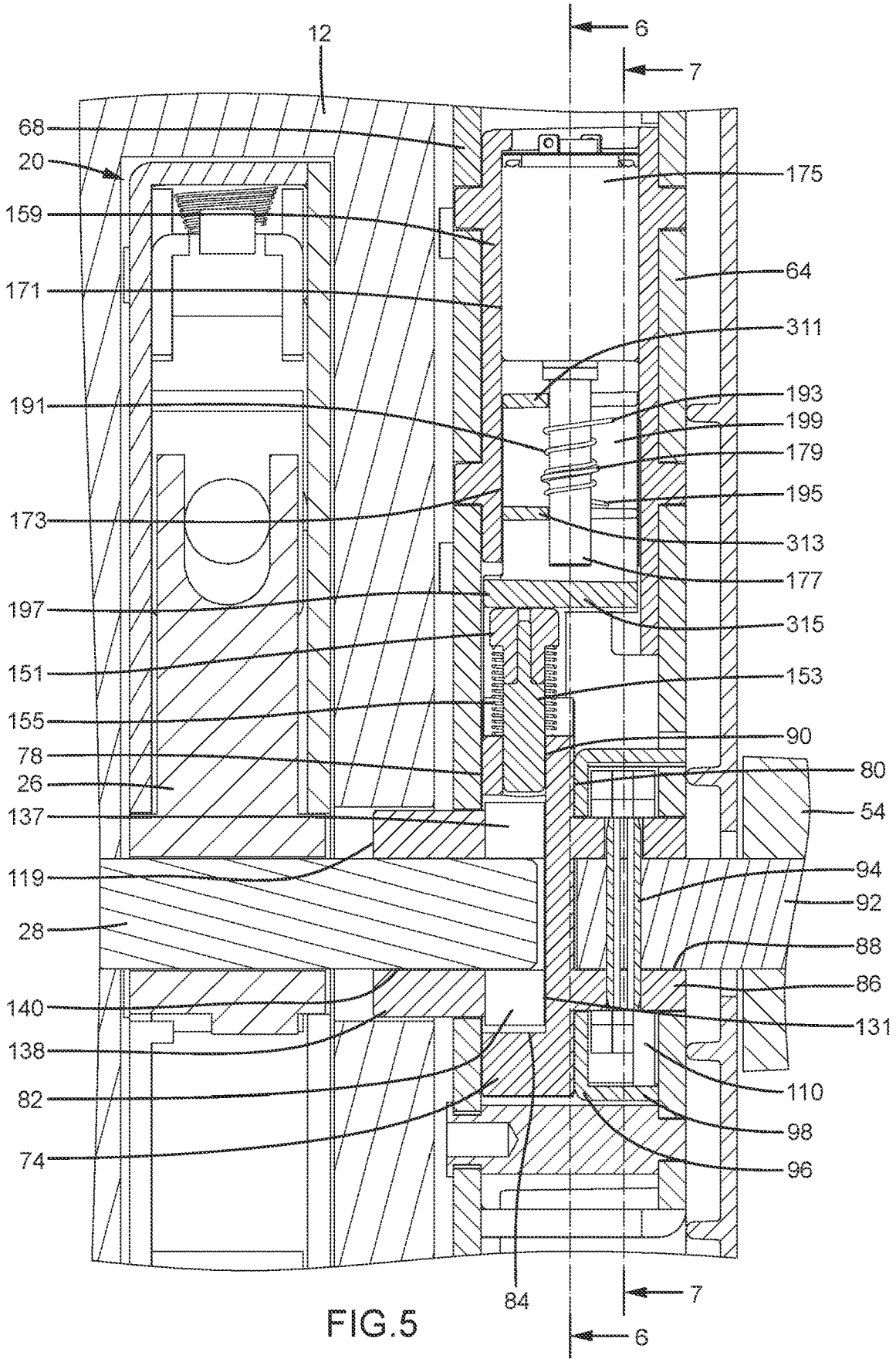
FIG. 5 is a cross sectional view taken along section line 5-5 of FIG. 4.
Figure 6:
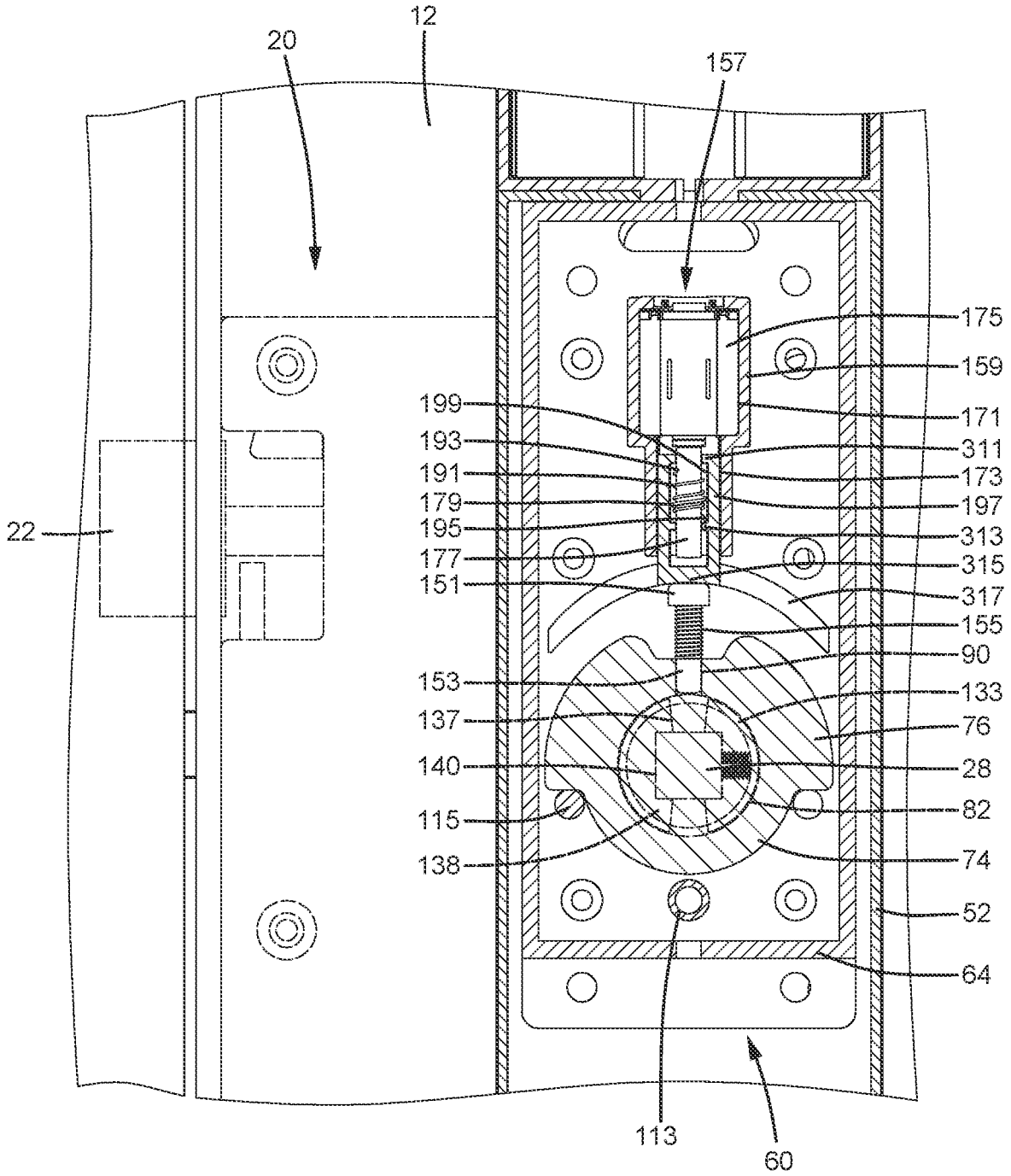
FIG. 6 is a cross sectional view taken along section line 6-6 of FIG. 5.
Figure 6A:
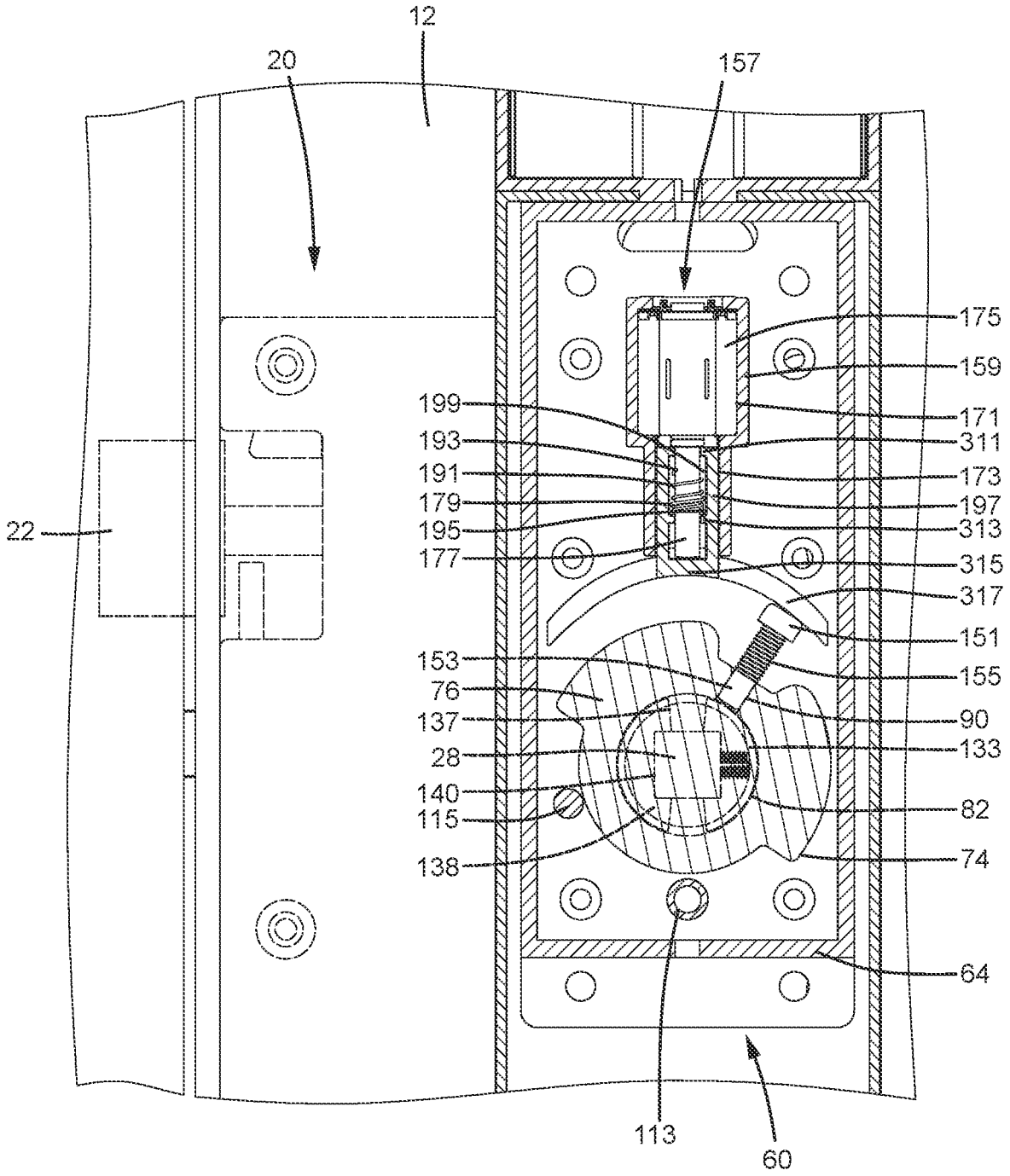
FIG. 6A is a view similar to FIG. 6 with a clutch member of the clutch in a disengagement position and with an outer handle pivoted.
Figure 7:
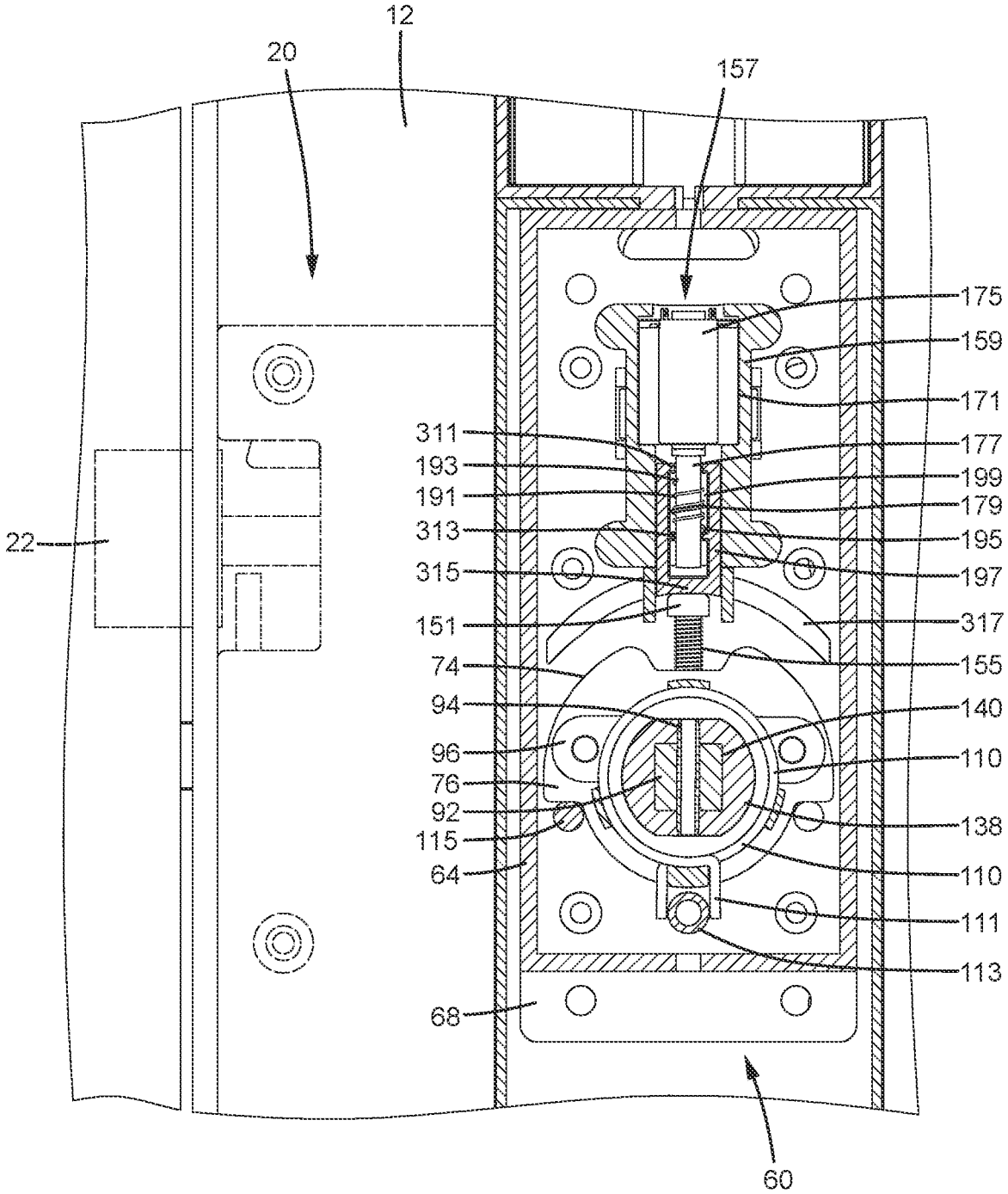
FIG. 7 is a cross sectional view taken along section line 7-7 of FIG. 5.
Figure 8:
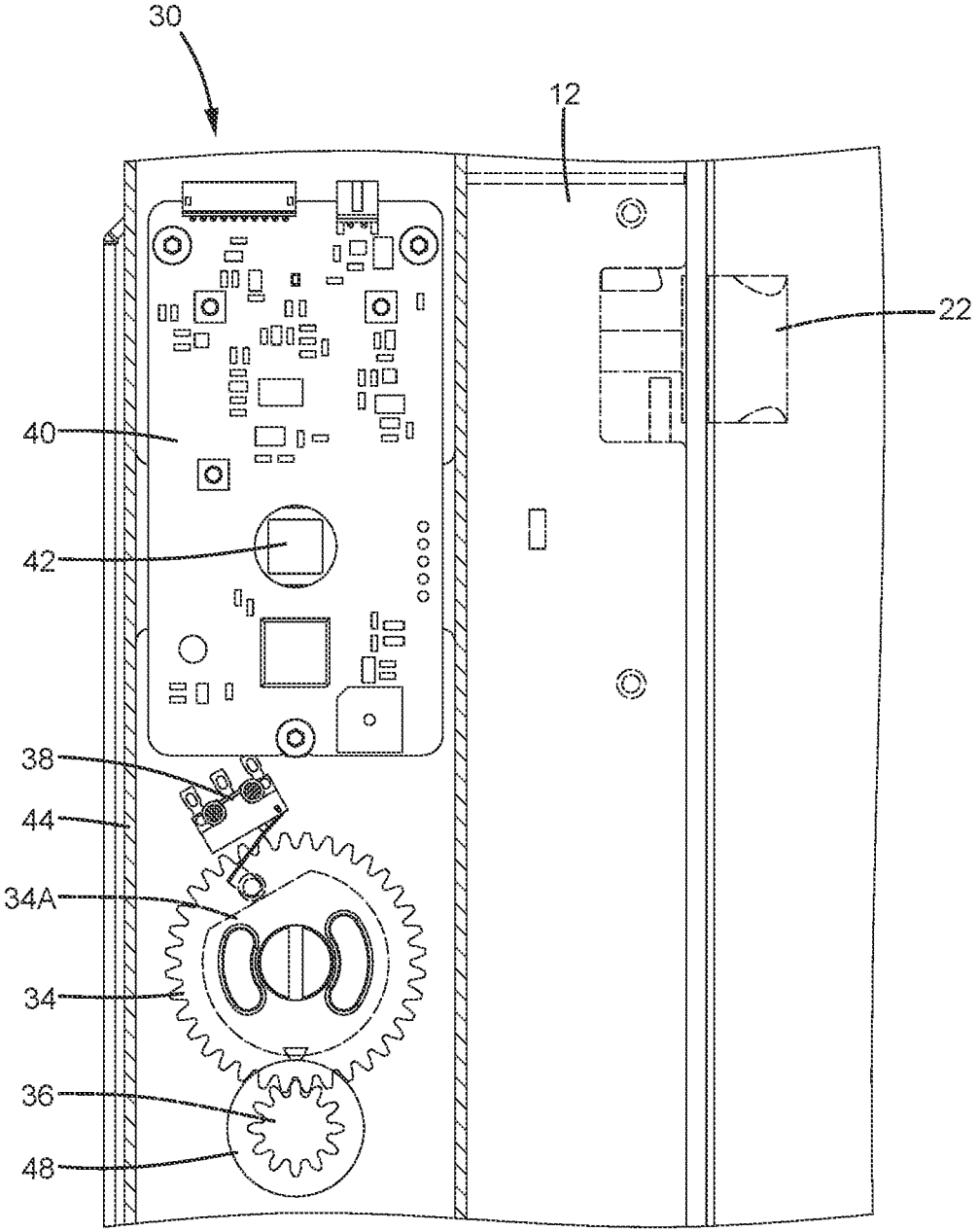
FIG. 8 is a cross sectional view taken along section line S-S of FIG. 4.

When the shaft 177 rotates in a first direction, the helical elastic element 191 moves towards the intermediate member 74, and the second tang 195 abuts against the second wall 311 of the sliding block 197, such that the sliding block 197 can be pushed towards the intermediate member 74. Thus, the clutch member 139 moves from the disengagement position (FIGS. 5 and 6) to the engagement position (FIGS. 9 and 10). When the shaft 177 rotates in a second direction reverse to the first direction, the helical elastic element 191 moves away from the intermediate member 73, and the first tang 193 abuts against the first wall 311 of the sliding block 197, such that the sliding block 197 can be pushed away from the intermediate member 74. Thus, the clutch member 139 is biased by the supporting spring 155 to move from the engagement position (FIGS. 9 and 10) to the disengagement position (FIGS. 5 and 6).

The clutch 60 is mounted between the outer escutcheon 52 and the latch device 20. The driving rod 28 of the latch device 20 is coupled with the engaging hole 140 of the coupling member 117 to pivot jointly. An end of the spindle 92 on an outer side of the outer escutcheon 52 is jointly pivotable with the outer handle 54 (FIG. 5). Thus, when the outer handle 54 is not subject to any external force, the intermediate member 74 is retained in the initial position under the bias of the torsion spring 110. As a result, the lever of the outer handle 54 is substantially in the horizontal direction. When the outer handle 54 is pivoted, the actuating member 96 pivots, such that the push block 98 presses against one of the two ends 111 of the torsion spring 111. When the outer handle 54 is released, the torsion spring 110 returns the actuation member 96 as well as the intermediate member 74 and the outer handle 54.

It is noted that the clutch 60 is electrically connected to the main board 40. The main board 40 cooperates with the sensor 38, the lock core 56, and the second latch 24 to control the clutch 60 and, thus, control permission of movement of the clutch member 139 to the engagement position.

With reference to FIGS. 5-8, for ease of explanation, it is assumed that the lock device 10 is connected with a smart mobile device via Blue-tooth technology, and a biological feature is inputted via the smart mobile device to identify whether to unlock.

It is further assumed that the door 12 is closed, the first latch 22 of the latch device 20 is in the latching position engaged with the door frame around the door 12. The intermediate member 74 is in the initial position. The engaging groove 137 of the coupling member 117 is aligned with the engaging arm 153 of the clutch member 139. The clutch member 139 is in the disengagement position. The second latch 24 is in the retracted position. The activation portion 34A of the follower wheel 34 does not activate the sensor 38. Thus, the main hoard 40 is set to a state permitting the driving device 157 of the clutch 60 to push the clutch member 139 to the engagement position after the biological feature is entered into the smart mobile device and is identified as being correct, and the lock device 10 is unlocked.

When the clutch member 139 is in the disengagement position, the intermediate member 74 cannot pivot together with the coupling member 117. Thus, when the outer handle 54 is pivoted, the spindle 92 is actuated to cause pivotal movement of the intermediate member 74 and the push block 98. During pivotal movement of the intermediate member 74, the coupling member 117 remains still. Thus, the actuating member 26 and the driving rod 28 of the latch device 20 also remains still, such that the clutch member 139 in the disengagement position does not permit opening of the door 12 by operating the outer handle 54. This provides a locking function for the outer side of the door 12 (such as an outdoor condition).

It is noted that even though the clutch member 139 is in the disengagement position, when the inner handle 46 pivots, the inner connecting member 42 is actuated to cause pivotal movement of the driving rod 28 and the actuating member 26, such that the first latch 22 moves from the latching position to the unlatching position, permitting opening of the door 12.

Assuming that the biological feature inputted via the smart mobile device is identified as being correct and the sensor 38 is not activated (the second latch 24 is in the retracted position), the motor 175 of the driving device 157 of the clutch 60 rotates in the first direction. With reference to FIGS. 9 and 10, the threaded section 179 of the shaft 177 pushes the helical elastic element 191 towards the intermediate member 74. The second tang 195 of the helical elastic element 191 pushes the sliding block 197 towards the intermediate member 74, and the activation end 315 of the sliding block 197 actuates the clutch member 139 to move from the disengagement position to the engagement position. The engaging arm 153 of the clutch member 139 engages with the engaging groove 137 of the coupling member 117.

With reference to FIG. 11, in a case that the engaging arm 153 engages with the engaging groove 137 of the coupling member 117, when the outer handle 54 is pivoted to cause pivotal movement of the intermediate member 74, the clutch member 139, and the actuating member 96, the actuating member 96 pushes the torsion spring 111 to store elastic force, and the clutch member 139 pushes the coupling member 117 to pivot, thereby causing pivotal movement of the driving rod 28 and the actuating member 26. Thus, the first latch 22 moves from the latching position to the unlatching position. Furthermore, with the clutch member 139 in the engagement position, pivotal movement of the inner handle 46 moves the first latch 22 from the latching position to the unlatching position.

With the clutch 139 in the engagement position, when the motor 175 drives the shaft 177 to rotate in the second direction (for example, a person moves from the outer side of the door 12 into the inner side of the door 12 or the period of time of the clutch member 139 in the engagement position exceeds a preset time period), the helical elastic element 191 moves away from the intermediate member 74 along the shaft 177. Furthermore, the first tang 193 of the helical elastic element 191 presses against the first wall 311 of the sliding block 197, moving the sliding block 197 away from the intermediate member 74, such that the supporting spring 155 pushes the clutch member 139 from the engagement position to the disengagement position. Thus, the outer handle 54 returns to the position incapable of moving the first latch 22 from the latching position to the unlatching position.

Figure 12:
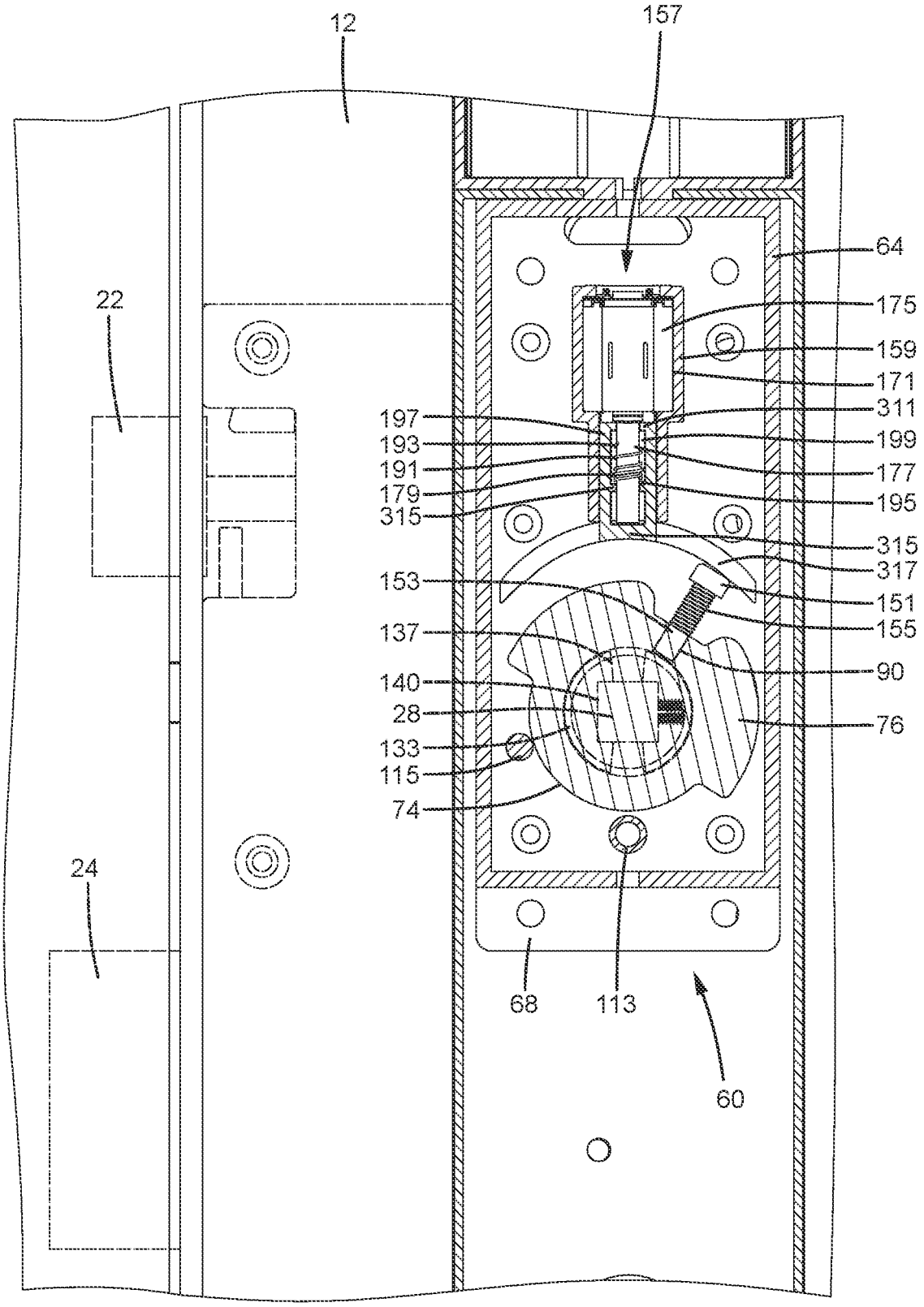
FIG. 12 is a view similar to FIG. 10 with the clutch member in a disengagement position and with the outer handle pivoted.
Figure 13:
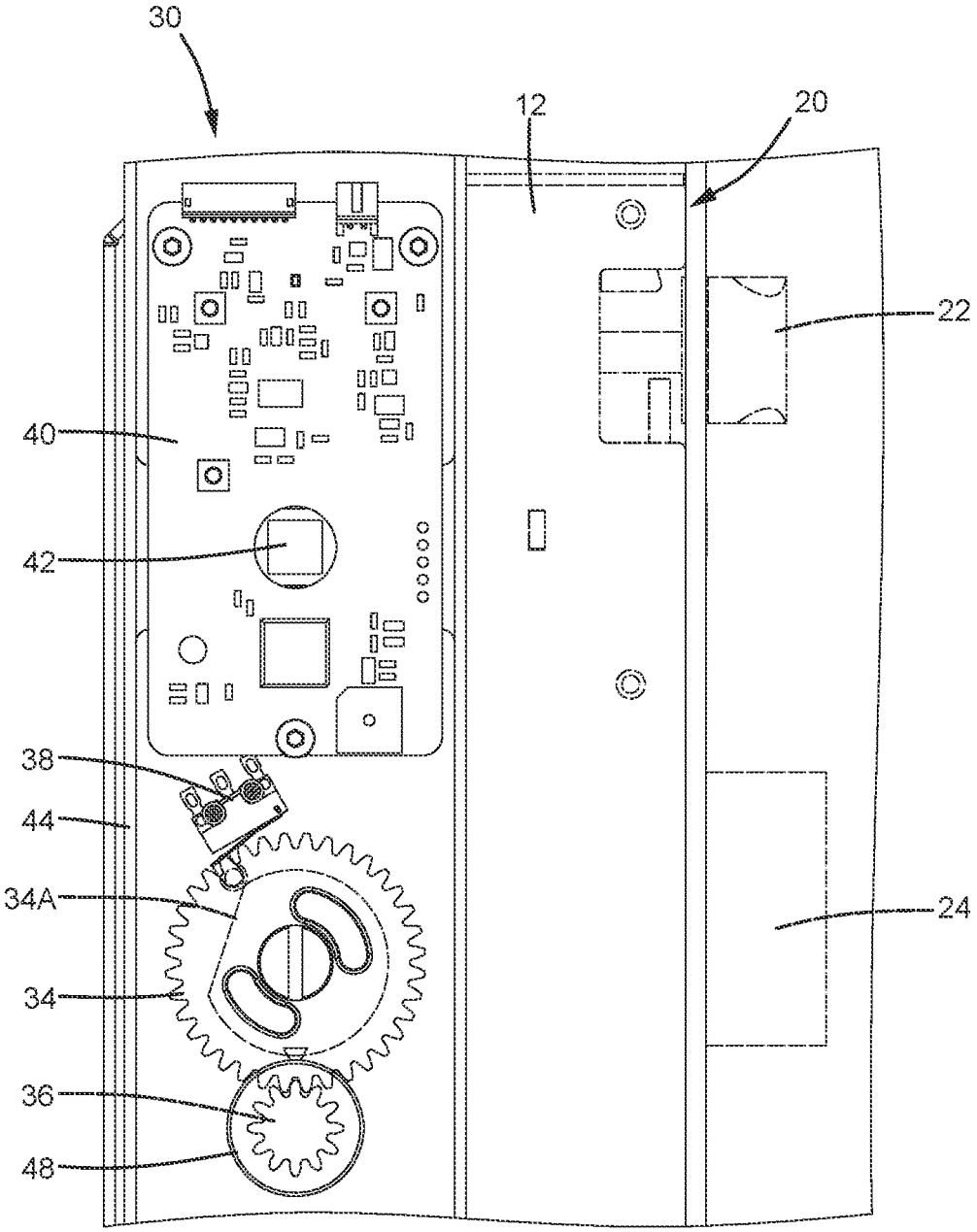
FIG. 13 is a view similar to FIG. 8 with a second latch moved to an extended position.

With reference to FIGS. 12 and 13, assuming that the door 12 is closed and the first latch 22 is in the latching position, the inner operating knob 48 or the lock core 56 is operated to move the second latch 24 to the extended position, such that the activating portion 34A of the follower wheel 34 presses against the sensor 39. Thus, the driving device 157 of the clutch 60 set by the main board 40 cannot operate to move the clutch member 139 from the disengagement position to the engagement position. In this state, even though the biological feature is inputted via the smart mobile device and is identified as being correct, the driving device 157 of the lock device 10 does not operate, and the clutch member 139 remains in the disengagement position. Thus, the coupling member 117 remains still when the outer handle 54 is pivoted, retaining the first latch 22 in the latching position.

When the second latch 24 is in the extended position, the first latch 22 can be moved from the latching position to the unlatching position when the inner handle 46 is pivoted. Nevertheless, since the second latch 24 remains in the extended position, the door 12 cannot be opened. Namely, when it is desired to open the door 12, a key is required to operate the lock core 56 from the outer side of the door 12 to move the second latch 24 to the retracted position, or the inner operating knob 48 at the inner side must be used to move the second latch 24 to the retracted position.

Figure 14:
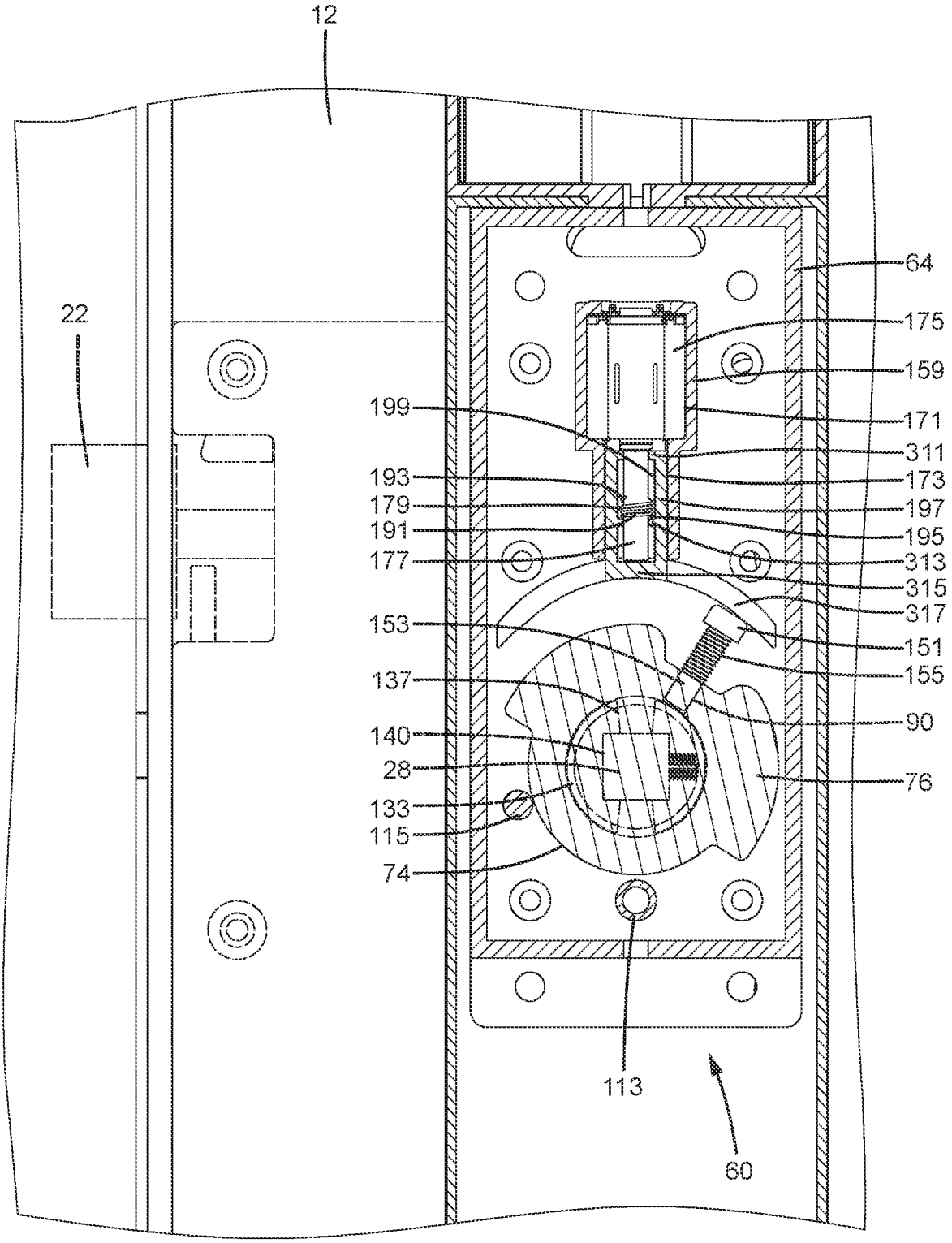
FIG. 14 is a view similar to FIG. 12 with a helical elastic element compressed when a shaft of a motor rotates in a first direction while the clutch member is prevented from being moved to the engagement position.
Figure 15:
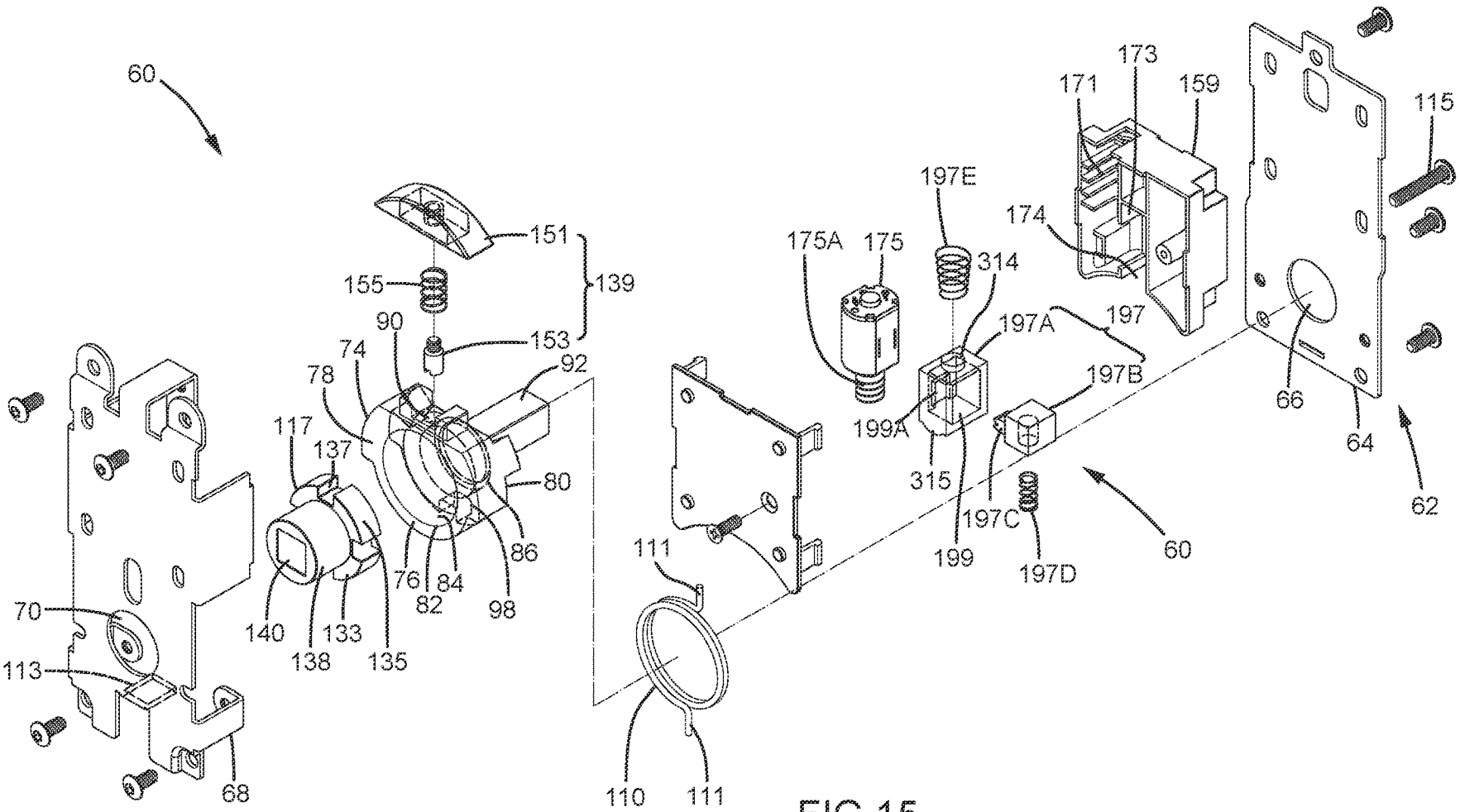
FIG. 15 is an exploded, perspective view of a clutch of a second embodiment according to the present invention.
Figure 16:
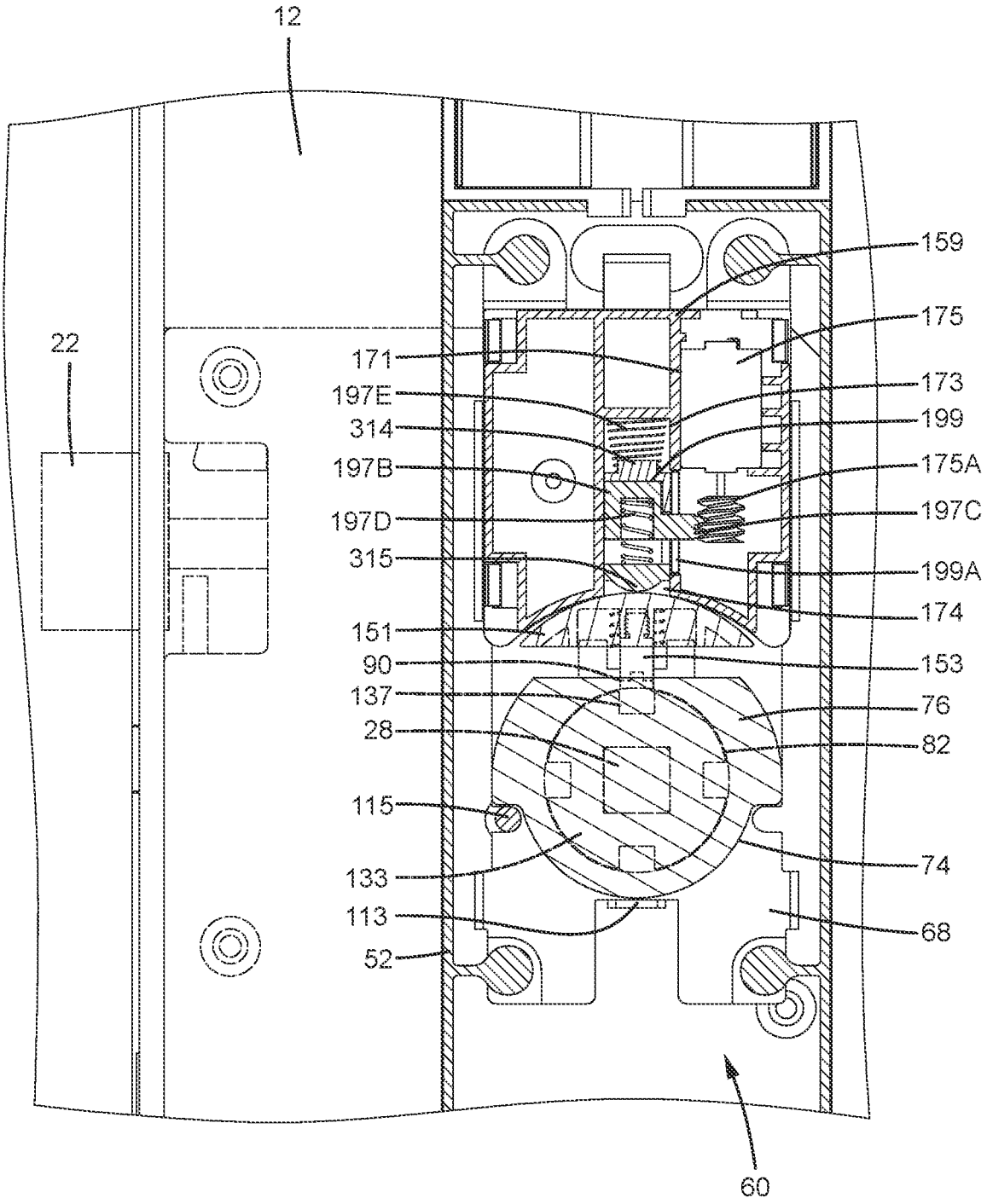
FIG. 16 is a cross sectional view illustrating the clutch mounted in an outer operating device according to the second embodiment.

With reference to FIG. 14, assuming the door 12 is closed, the first latch 22 is in the latching position, and the clutch member 139 is in the disengagement position, when the outer handle 54 is pivoted, the motor 175 rotates in the first direction to move the helical elastic element 191 along the shaft 177 towards the intermediate member 74 (such as the biological feature inputted via the smart mobile device is identified as being correct). Since the clutch member 139 is misaligned from the engaging groove 137, the clutch member 139 is retained in the disengagement position. Furthermore, since the extension arm 317 of the sliding block 197 abuts against the abutting portion 151 of the clutch member 139, the sliding block 197 cannot move towards the intermediate member 74, such that movement of the helical elastic element 191 towards the intermediate member 74 causes compression of the helical elastic element 19 by the threaded section 179 of the shaft 177 and the second wall 313 of the sliding block 197, storing elastic force. With the helical elastic element 191 in the compressed state, when the intermediate member 74 returns to the initial position (for example, the outer handle 54 is released), the clutch member 139 is aligned with the engaging groove 137 of the coupling member 117. The helical elastic element 191 pushes the sliding block 197 towards the intermediate member 74 under the action of the elastic force, such that the clutch member 139 moves from the disengagement position to the engagement position. The outer handle 54 can be used to actuate the first latch 22 to move from the latching position to the unlatching position.

Aside from the first embodiment illustrated in FIGS. 1-14, the lock device 10 may have variations and modifications. FIGS. 15-18 show a lock device 10 of a second embodiment according to the present invention. The second embodiment are different from the first embodiment by the driving device 157, the clutch member 139, and the intermediate member 74 of the clutch 60. Specifically, the driving device 157 of the second embodiment also includes an inner box 159 received in the outer box 62. The inner box 159 includes a receiving groove 171 and a sliding groove 173 on a side of the receiving groove 171. The sliding groove 173 includes a notch 174 at an outer surface of the inner box 159. The motor 175 is received in the receiving groove 171. A rotor of the motor 175 is coupled to the driving toothed portion 175A formed by a worm to rotate jointly.

The sliding block 197 of the clutch 60 of the second embodiment includes a first block 197A and a second block 197B. The first block 107A includes an inner end 314 and an activation end 315 without an extension arm 317. The first block 197A further includes a compartment 199 formed between the inner end 314 and the activation end 315. The first block 197A further includes an opening 199A extending from an outer surface thereof to the compartment 199. The first block 197A is received in the sliding groove 173. A biasing spring 197E is disposed between the inner end 314 of the first block 197A and an inner wall of the sliding groove 173. The biasing spring 197E biases the first block 197 towards the intermediate member 74. The activation end 315 10 of the first block 197A is adjacent to the notch 174.

The second block 197B includes a follower toothed portion 197C. The second block 197B is slidably received in the compartment 199 of the first block 197A. A push spring 197D is disposed between the second block 197B and an inner wall of the compartment 199. The push spring 197D biases the second block 197B against an inner sidewall of the compartment 199. The follower toothed portion 197C extends to the outer side of the first block 197A via the opening 199A. The sliding block 197 is received in the sliding groove 173. The follower toothed portion 197C meshes with the driving toothed portion 175A. Thus, when the driving toothed portion 175A does not rotate, the second block 197B does not displace. Nevertheless, the first block 197A may be pushed to compress the biasing spring 197E and to move the push spring 197D towards or away from the intermediate member 74.

The intermediate member 74 of the second embodiment is partially different from the first embodiment. Specifically, the intermediate member 74 of the second embodiment is integrally formed with the spindle 92. The push block 98 is directly and integrally formed on the second end face 80 of the intermediate member 74 and is without the actuating member 96. The remaining portion of the intermediate member 74 of the second embodiment is substantially the same as that of the intermediate member 74 of the first embodiment.

The clutch member 139 of the second embodiment also includes an abutting portion 151 made of plastic material and an engaging arm 153 made of metal material. Nevertheless, the abutting portion 151 of the second embodiment is larger and includes an arcuate outer periphery. By this arrangement, even though the intermediate member 74 is not in the initial position, the abutting portion 151 still abuts against the activation end 315 of the first block 197A.

Figure 17:
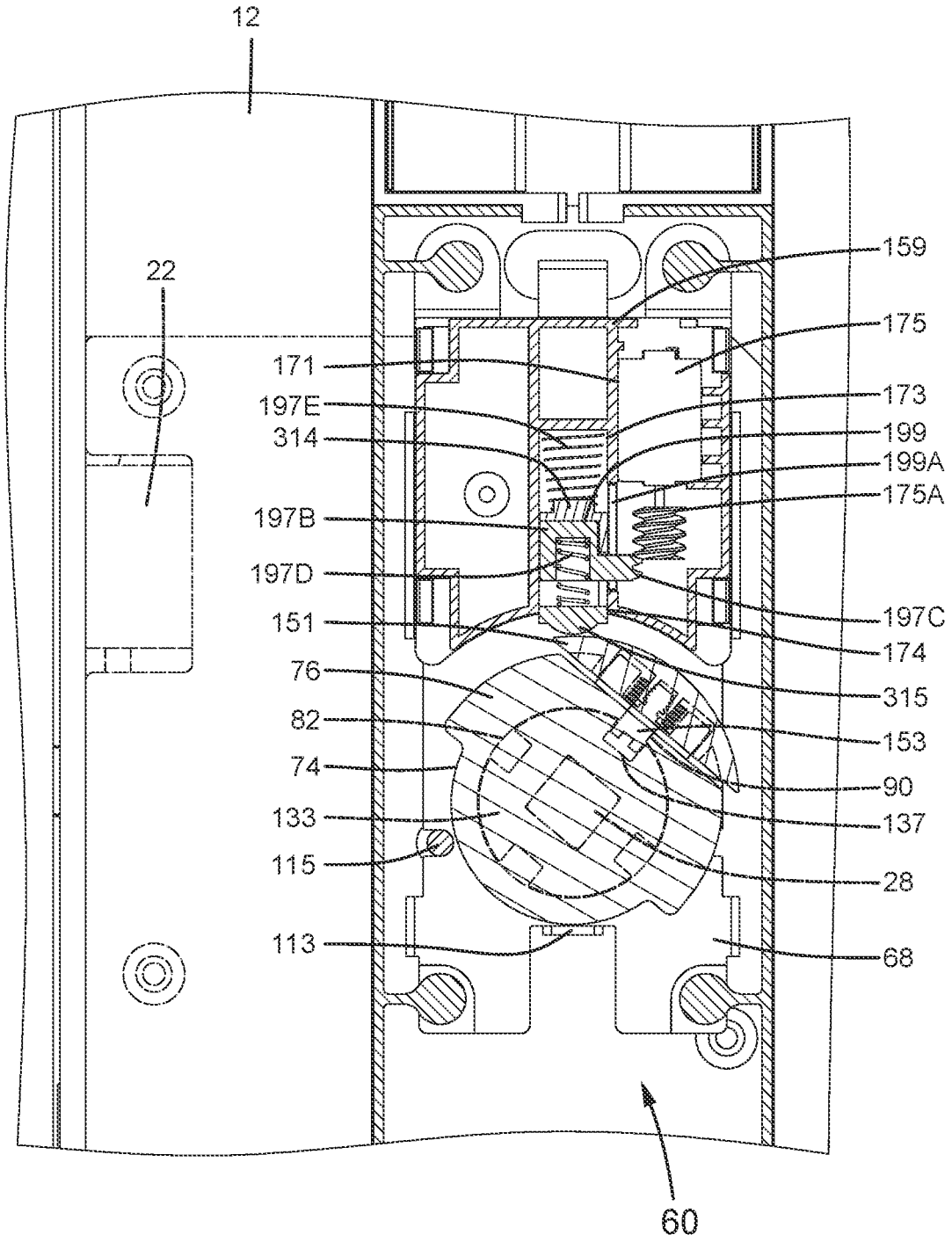
FIG. 17 is a view similar to FIG. 16 with a clutch member of the clutch in an engagement position and with an outer handle pivoted.

As can be understood from the figures and description illustrating the second embodiment, when the motor 175 drives the driving toothed portion 175A rotates in the first direction, the sliding block 197 moves towards the intermediate member 74. The clutch member 139 moves from the disengagement position to the engagement position. The engaging arm 153 engages with the engaging groove 137 of the coupling member 117. Thus, the intermediate member 74, the coupling member 117, and the outer handle 74 can pivot jointly to move the first latch 22 from the latching position (FIG. 16) to the unlatching position (FIG. 17). Likewise, when the outer handle 54 is released, the first latch 22 returns from the unlatching position to the latching position. When the motor 175 rotates in the second direction, the sliding block 197 moves away from the intermediate member 74. The clutch member 139 returns to the disengagement position, such that the first latch 22 cannot move from the latching position to the unlatching position by operating the outer handle 54.

Figure 18:
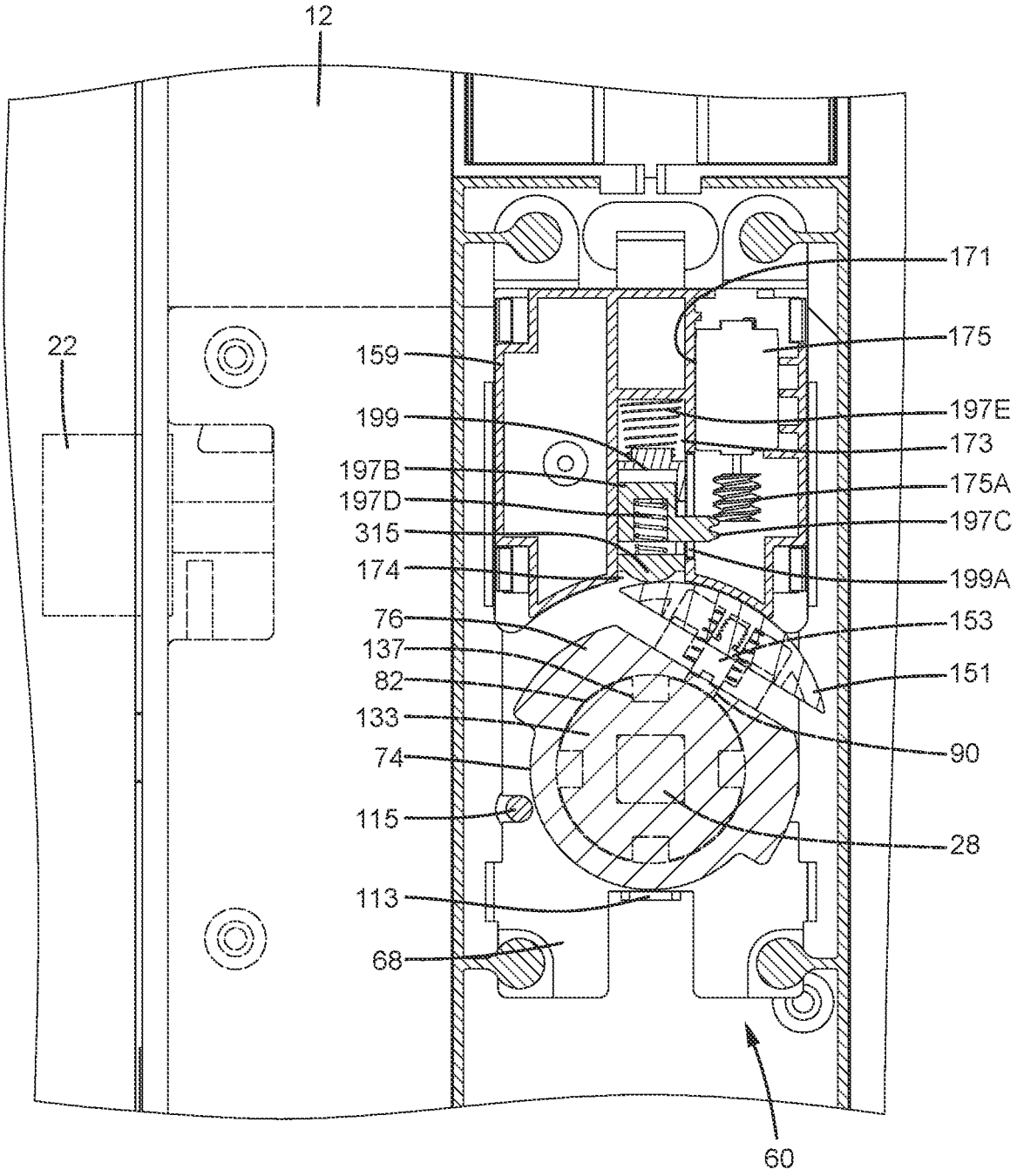
FIG. 18 is a view similar to FIG. 16 with the clutch member in a disengagement position and with the outer handle pivoted.

With reference to FIG. 18, with the intermediate member 74 in the initial position and the clutch member 139 in the disengagement position, when the driving toothed portion 175A rotates in the first direction, since the clutch member 139 is misaligned from the engaging groove 137, the first block 197A is pressed by the clutch member 139 and, thus, cannot move towards the intermediate member 74. Thus, only the second block 197B can compress the push spring 197D towards the intermediate member 74. In this state, when the intermediate member 74 returns to the initial position, the clutch member 139 is aligned with the engaging groove 137, the push spring 197D will push the first block 197A towards the intermediate member 74, such that the clutch member 139 can move from the disengagement position to the engagement position.

According to the illustrated embodiments, the clutch 60 and the inner and outer operating devices 30 and 50 may be varied without altering the latch device 20, providing electronic control of the mechanical type latch device 20 to achieve the locking function (such that the first latch 22 cannot move to the unlatching position by operating the outer handle 54) or the unlocking function (such that the first latch 22 can move to the unlatching position by operating the outer handle 54). Thus, redesigning and corresponding manufacturing of the latch device 20 for electronic control are not required. Namely, currently available mechanical type latch device 20 can be used, reducing the costs of manufacturing and design. For general consumers, the mechanical type latch device 20 can still be used to achieve electronic control by replacing the inner and outer operating devices 30 and 50.

The threaded section 179 of the shall 177 include only one turn, which causes less restriction to the helical elastic element 191. Thus, the compression extent of the helical elastic element 191 along the longitudinal axis of the shaft 177 may be maximized. The motor 175 can still rotate in the first direction when the clutch member 139 cannot move, reducing damage to the motor 175 resulting from erroneous operation.

The abutting portion 151 of the clutch member 139 may be made of plastic material, such that the friction between the abutting portion 151 and the sliding block 197 can be reduced during rotation of the intermediate member 74, permitting smoother operation of the outer handle 54.

Now that the basic teachings of the present invention have been explained, many extensions and variations will he obvious to one having ordinary skill in the art. For example, the main board 40 can be disposed to the driving device 157, rather than disposition in the inner operating device 30. Furthermore, the lock device 10 does not have to include the sensor 38 and the follower wheel 34 without affecting control of the outer handle 54 provided by the clutch 60 for moving or not moving the first latch 22 to the unlatching position. Furthermore, the lock device 10 may be unlocked by using techniques other than the facial feature through a smart mobile device. For example, the lock device 10 may include a password input device on the outer operating device 50, and a password can be inputted to unlock the lock device 20.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lock device comprising:

a latch device including a first latch movable between a latching position and an unlatching position;

an outer escutcheon to an outer side of the latch device;

an outer handle pivotably mounted to an outer side of the outer escutcheon; and a clutch disposed on the outer side of the latch device and located on an inner side of the outer escutcheon, wherein the clutch includes a pivotable intermediate member coupled to the outer handle to pivot therewith, wherein the clutch further includes a coupling member operatively coupled to the first latch, wherein the coupling member is configured to or not to jointly pivot with the intermediate member, wherein when the coupling member and the intermediate member are jointly pivotable, pivotal movement of the outer handle causes the first latch to move from the latching position or the unlatching position, and wherein when the coupling member is not jointly pivotable with the intermediate member, pivotal movement of the outer handle is incapable of causing movement of the first latch.

2. The lock device as claimed in claim 1, wherein the clutch further includes a clutch member movably coupled to the intermediate member and jointly pivotable with the intermediate member, wherein the clutch member includes an engaging arm, wherein the clutch member is movable along a pivotal axis of the intermediate member between an engagement position and a disengagement position, wherein when the clutch member is in the engagement position, the coupling member and the intermediate member are jointly pivotable, and wherein when the clutch member is in the disengagement position, the coupling member is incapable of pivoting jointly with the intermediate member.

3. The lock device as claimed in claim 2, wherein the intermediate member further includes a mounting hole extending along the pivotal axis of the intermediate member and a through-hole extending in a radial direction perpendicular to the pivotal axis of the intermediate member and extending from an outer side of the intermediate member to the mounting hole, wherein the clutch member is movably received in the through-hole, wherein the coupling member includes a pivotal portion having an outer periphery and an engaging groove extending from the outer periphery, wherein the pivotal portion is pivotally received in the mounting hole, wherein when the clutch member is aligned with the engaging groove, the clutch member is movable from the disengagement position to the engagement position, wherein when the clutch member is not aligned with the engaging groove, the clutch member is not movable from the disengagement position to the engagement position, wherein when the clutch member is in the disengagement position, the engaging arm is located on an outer side of the engaging groove, and wherein when the clutch member is in the engagement position, the engaging arm engages with the engaging groove.

4. The lock device as claimed in claim 3, wherein the clutch member further includes a driving device including:

a motor;

a shaft configured to be driven by the motor to rotate, wherein the shaft includes an outer periphery having a threaded section;

a helical elastic element in threading connection with the threaded section of the shaft, wherein the helical elastic element is compressible and includes a first tang and a second tang, wherein the helical elastic element moves along a longitudinal axis of the shaft when the shaft rotates; and a sliding block including a compartment having first and second walls opposite to each other, wherein the sliding block further includes an activation end located outside of the compartment, wherein the second wall is located between the first wall and the activation end along the longitudinal axis of the shaft, wherein the sliding block further includes an extension arm extending from the activation arm, wherein the shaft is received in the compartment, wherein the first tang of the helical elastic element is adjacent to the first wall, wherein the second tang of the helical elastic element is adjacent to the second wall, wherein the first tang and the second tang are configured to be restricted and retained in place by the first and second walls when the shaft rotates, wherein when the helical elastic element moves and the first tang abuts against the first wall, the sliding block moves away from the intermediate member along the longitudinal axis of the shaft, and the clutch member moves to the disengagement position, wherein when the helical elastic element moves and the second tang abuts against the second wall, the sliding block moves towards the intermediate member along the longitudinal axis of the shaft, and the clutch member moves to the engagement position, wherein when the clutch member is not aligned with the engaging groove and the helical elastic element moves towards the intermediate member, a section of the helical elastic element between the threaded section and the second tang is compressed by the threaded section and the second wall.

5. The lock device as claimed in claim 4, wherein the threaded section of the shaft has one turn, wherein the helical elastic element is a compression spring, wherein each of the first and second tangs is rectilinear and extends in a tangential direction of an associated one of two ends of the compression spring.

6. The lock device as claimed in claim 4, further comprising a supporting spring, wherein the clutch member further includes an abutting portion which is larger than the engaging arm and made of plastic material, wherein the engaging arm is made of metal material, wherein the abutting portion is located on an outer side of the intermediate member and abuts against one of the activation end and the extension arm of the sliding block, wherein the supporting spring is disposed between the abutting portion and the intermediate member and biases the clutch member to the disengagement position.

7. The lock device as claimed in claim 3, further comprising:

an actuating member, wherein the intermediate member further includes a first end face and a second end face spaced from the first end face along the pivotal axis of the intermediate member, wherein the mounting hole extends from the first end face along the pivotal axis of the intermediate member but spaced from the second end face, wherein the actuating member is mounted on the second end face 80 of the intermediate member, and wherein the actuating member includes a push block protruding towards the second end face;

an outer box mounted to the outer escutcheon and including a stop member, wherein the intermediate member, the coupling member, and the driving device are received in the outer box; and a torsion spring having two ends, wherein the stop member and the push block are located between the two ends of the torsion spring, wherein the two ends of the torsion spring biases the push block to retain the intermediate member in an initial position in which the clutch member is aligned with the engaging groove.

8. The lock device as claimed in claim 3, wherein the clutch further includes a driving device including:

an inner box;

a motor including a driving toothed portion, wherein the motor is received in an inner box;

a sliding block including:

a first block received in the inner box and movable along a rotational axis of the driving toothed portion, wherein the first block includes an inner end and an activation end, wherein the first block further includes a compartment formed between the inner end and the activation end, wherein the first block further includes an opening extending from an outer surface thereof to the compartment, and wherein the clutch member abuts against the activation end;

a second block received in the compartment and movable relative to the first block along the rotational axis of the driving toothed portion, wherein the second block further includes a follower toothed portion extending out of the first block via the opening and meshed with the driving toothed portion;

a push spring disposed between the second block and a sidewall of the compartment, wherein the push spring biases the second block against another sidewall of the compartment, wherein when the driving toothed portion rotates while the clutch member is aligned with the engaging groove and, the first and second blocks together move along the rotational axis of the driving toothed portion, wherein when the driving toothed portion rotates while the clutch member is not aligned with the engaging groove, the first block is not moved, and the second block moves along the rotational axis of the driving toothed portion towards the intermediate member and compresses the push spring.

9. The lock device as claimed in claim 8, further comprising:

an outer box mounted on the outer escutcheon and including a stop member, wherein the intermediate member, the coupling member, and the driving device are received in the outer box, wherein the intermediate member further includes a first end face and a second end face spaced from the first end face along the pivotal axis of the intermediate member, wherein the mounting hole extends from the first end face along the pivotal axis of the intermediate member but spaced from the second end face, and wherein the intermediate member further includes a push block protruding towards the second end face; and a torsion spring having two ends, wherein the stop member and the push block are located between the two ends of the torsion spring, wherein the two ends of the torsion spring biases the push block to retain the intermediate member in an initial position in which the clutch member is aligned with the engaging groove.

10. The lock device as claimed in claim 1, further comprising an inner operating device mounted to another side of the latch device, wherein the latch device further includes a second latch, wherein the inner operating device includes a main board and a sensor electrically connected to the main board, wherein the inner operating device further includes an inner operating knob operatively connected to the second latch, wherein the inner operating knob is configured to activate the sensor, wherein rotation of the inner operating knob causes movement of the second latch between an extended position and a retracted position, wherein when the second latch is in the extended position, the sensor is in one of an activated state and a non-activated state, and the driving device is not operable, such that the clutch member is incapable of moving from the disengagement position to the engagement position, and wherein when the second latch is in the retraced position, the sensor is in another of the activated state and the non-activated state, and the driving device is operable, such that the clutch member is movable from the disengagement position to the engagement position.

11. The lock device as claimed in claim 10, further comprising a lock core mounted to the outer escutcheon, wherein a portion of the lock core is located in the latch device, wherein the lock core is operatively connected to the second latch, wherein the inner operating knob is operatively connected to the lock core, wherein the inner operating device further includes an assembling member, wherein the main board and the sensor are mounted to the assembling member, wherein the inner operating device further includes a follower wheel pivotably mounted to the assembling member and a driving wheel meshed with the follower wheel, wherein the follower wheel is operatively coupled between the inner operating knob and the lock core, wherein the follower wheel includes an activating portion, wherein when the second latch is in the retracted position, the sensor is not activated by the activating portion, and wherein when the second latch is in the extended position, the sensor is activated by the activating portion.

12. The lock device as claimed in claim 3, wherein the clutch further includes a driving device including:

an inner box;

a motor including a driving toothed portion, wherein the motor is received in an inner box;

a sliding block including:

a first block received in the inner box and movable along a rotational axis of the driving toothed portion, wherein the first block includes an inner end and an activation end, wherein the first block further includes a compartment formed between the inner end and the activation end, wherein the first block further includes an opening extending from an outer surface thereof to the compartment, and wherein the clutch member abuts against the activation end;

a second block received in the compartment and movable relative to the first block along the rotational axis of the driving toothed portion, wherein the second block further includes a follower toothed portion extending out of the first block via the opening and meshed with the driving toothed portion;

a push spring disposed between the second block and a sidewall of the compartment, wherein the push spring biases the second block against another sidewall of the compartment, wherein when the driving toothed portion rotates while the clutch member is aligned with the engaging groove and, the first and second blocks together move along the rotational axis of the driving toothed portion, wherein when the driving toothed portion rotates while the clutch member is not aligned with the engaging groove, the first block is not moved, and the second block moves along the rotational axis of the driving toothed portion towards the intermediate member and compresses the push spring.

13. A clutch adapted to be mounted to an outer side of a latch device of a lock device and configured to be operatively connected to an outer operating device of the lock device, with the clutch comprises:

an outer box;

an intermediate member pivotably connected to the outer box, wherein the intermediate member is configured to couple with an outer handle of the outer operating device to pivot therewith;

a torsion spring disposed between the intermediate member and the outer box, wherein the torsion spring biases the intermediate member to an initial position, and a coupling member pivotably mounted between the intermediate member and the outer box, wherein the coupling member is configured to be operatively connected to a first latch of the latch device, wherein the coupling member is configured to control the intermediate member to or not to pivot jointly with the intermediate member, wherein when the coupling member and the intermediate member are jointly pivotable, pivotal movement of the outer handle causes the first latch to move from the latching position or the unlatching position, and wherein when the coupling member is not jointly pivotable with the intermediate member, pivotal movement of the outer handle is incapable of causing movement of the first latch.

14. The clutch as claimed in claim 13, wherein the clutch further includes a clutch ember movably coupled to the intermediate member and jointly pivotable with the intermediate member, wherein the clutch member includes an engaging arm, wherein the clutch member is movable along a pivotal axis of the intermediate member between an engagement position and a disengagement position, wherein when the clutch member is in the engagement position, the coupling member and the intermediate member are jointly pivotable, and wherein when the clutch member is in the disengagement position, the coupling member is incapable of pivoting jointly with the intermediate member.

15. The clutch as claimed in claim 14, wherein the intermediate member further includes a mounting hole extending long the pivotal axis of the intermediate member and a through-hole extending in a radial direction perpendicular to the pivotal axis of the intermediate member and extending from an outer side of the intermediate member to the mounting hole, wherein the clutch member is movably received in the through-hole, wherein the coupling member includes a pivotal portion having an outer periphery and an engaging groove extending from the outer periphery, wherein the pivotal portion is pivotably received in the mounting hole, wherein when the clutch member is aligned with the engaging groove, the clutch member is movable from the disengagement position to the engagement position, wherein when the clutch member is not aligned with the engaging groove, the clutch member is not movable from the disengagement position to the engagement position, wherein when the clutch member is in the disengagement position, the engaging arm is located on an outer side of the engaging groove, and wherein when the clutch member is in the engagement position, the engaging arm engages with the engaging groove.

16. The clutch as claimed in claim 14, wherein the clutch further includes a driving device including:

a motor;

a shaft configured to be driven by the motor to rotate, wherein the shaft includes an outer periphery having a threaded section;

a helical elastic element in threading connection with the threaded section of the shaft, wherein the helical elastic element is compressible and includes a first tang and a second tang, wherein the helical elastic element moves along a longitudinal axis of the shaft when the shaft rotates; and a sliding block including a compartment having first and second walls opposite to each other, wherein the sliding block further includes an activation end located outside of the compartment, wherein the second wall is located between the first wall and the activation end along the longitudinal axis of the shall, wherein the sliding block further includes an extension arm extending from the activation arm, wherein the shaft is received in the compartment, wherein the first tang of the helical elastic element is adjacent to the first wall, wherein the second tang of the helical elastic element is adjacent to the second wall, wherein the first tang and the second tang are configured to be restricted and retained in place by the first and second walls when the shaft rotates, wherein when the helical elastic element moves and the first tang abuts against the first wall, the sliding block moves away from the intermediate member along the longitudinal axis of the shaft, and the clutch member moves to the disengagement position, wherein when the helical elastic element moves and the second tang abuts against the second wall, the sliding block moves towards the intermediate member along the longitudinal axis of the shaft, and the clutch member moves to the engagement position, wherein when the clutch member is not aligned with the engaging groove and the helical elastic element moves towards the intermediate member, a section of the helical elastic element between the threaded section and the second tang is compressed by the threaded section and the second wall.

17. The clutch as claimed in claim 16, wherein the threaded section of the shaft has one turn, Wherein the helical elastic element is a compression spring, wherein each of the first and second tangs is rectilinear and extends in a tangential direction of an associated one of two ends of the compression spring.

18. The clutch as claimed in claim 15, further comprising a supporting spring, wherein the clutch member further includes an abutting portion which is larger than the engaging arm and made of plastic material, wherein the engaging arm is made of metal material, wherein the abutting portion is located on an outer side of the intermediate member and abuts against one of the activation end and the extension arm of the sliding block, wherein the supporting spring is disposed between the abutting portion and the intermediate member and biases the clutch member to the disengagement position.

19. The clutch as claimed in claim 15, further comprising:

an outer box mounted on the outer escutcheon and including a stop member, wherein the intermediate member, the coupling member, and the driving device are received in the outer box, wherein the intermediate member further includes a first end face and a second end face spaced from the first end face along the pivotal axis of the intermediate member, wherein the mounting hole extends from the first end face 78 along the pivotal axis of the intermediate member but spaced from the second end face, and wherein the intermediate member further includes a push block protruding towards the second end face; and a torsion spring having two ends, wherein the stop member and the push block are located between the two ends of the torsion spring, wherein the two ends of the torsion spring biases the push block to retain the intermediate member in an initial position in which the clutch member is aligned with the engaging groove.

* * * * *